US010859957B2

(12) United States Patent
Mitsuhashi

(10) Patent No.: US 10,859,957 B2
(45) Date of Patent: Dec. 8, 2020

(54) TONER CARTRIDGE EXTRUSION DEVICE AND IMAGE FORMING APPARATUS INCLUDING THE SAME

(71) Applicant: SHARP KABUSHIKI KAISHA, Sakai (JP)

(72) Inventor: Kunihiro Mitsuhashi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/660,606

(22) Filed: Oct. 22, 2019

(65) Prior Publication Data

US 2020/0133180 A1 Apr. 30, 2020

(30) Foreign Application Priority Data

Oct. 30, 2018 (JP) ..... 2018-204195

(51) Int. Cl.
*G03G 15/00* (2006.01)
*G03G 15/08* (2006.01)

(52) U.S. Cl.
CPC ..... *G03G 15/50* (2013.01); *G03G 15/0865* (2013.01)

(58) Field of Classification Search
CPC .. G03G 15/50; G03G 15/087; G03G 15/0865; G03G 15/0867; G03G 15/0868; G03G 15/0872; G03G 2215/066; G03G 2215/068; G03G 2215/0685; G03G 2215/0695
See application file for complete search history.

(56) References Cited

U.S. PATENT DOCUMENTS

2016/0054680 A1* 2/2016 Okuda ..... G03G 15/0875 399/258

FOREIGN PATENT DOCUMENTS

JP 2010-044265 A 2/2010
JP 2016-177115 A 10/2016

* cited by examiner

*Primary Examiner* — Thomas S Giampaolo, II
(74) *Attorney, Agent, or Firm* — ScienBiziP, P.C.

(57) ABSTRACT

A toner cartridge extrusion device that extrudes a toner cartridge with a driving force of a driver is provided. The toner cartridge extrusion device includes a single detector that performs drive detection to detect drive of the driver and extrusion detection to detect whether or not the toner cartridge has been extruded.

8 Claims, 42 Drawing Sheets

TONER CARTRIDGE EXTRUSION DEVICE AND IMAGE FORMING APPARATUS INCLUDING THE SAME

BACKGROUND OF THE INVENTION

Field of the Invention

The present invention relates to a toner cartridge extrusion device for extruding a toner cartridge with a driving force of a driver and an image forming apparatus including the toner cartridge extrusion device, such as a copy machine, a multifunction machine, a printer device, and a facsimile device.

Description of the Background Art

An image forming apparatus configured such that a toner cartridge is detachably replaceable has been typically known (see, e.g., Japanese Unexamined Patent Application Publication No. 2010-44265). For replacing the toner cartridge, a toner cartridge extrusion device for extruding the toner cartridge with a driving force of a driver has been proposed (see, e.g., Japanese Unexamined Patent Application Publication No. 2016-177115).

In such a typical toner cartridge extrusion device, drive detection to detect drive of the driver is performed by a first detector, and extrusion detection to detect whether or not the toner cartridge has been extruded is performed by a second detector provided separately from the first detector. For this reason, a configuration for performing drive detection for the driver and extrusion detection for the toner cartridge is complicated.

For this reason, an object of the present invention is to provide a toner cartridge extrusion device capable of implementing drive detection for a driver and extrusion detection for a toner cartridge with a simple configuration and an image forming apparatus including the toner cartridge extrusion device.

SUMMARY OF THE INVENTION

For solving the above-described problem, the toner cartridge extrusion device according to the present invention that extrudes a toner cartridge with a driving force of a driver includes a single detector that performs drive detection to detect drive of the driver and extrusion detection to detect whether or not the toner cartridge has been extruded.

Moreover, the image forming apparatus according to the present invention includes the toner cartridge extrusion device according to the present invention.

According to the present invention, drive detection for the driver and extrusion detection for the toner cartridge can be implemented with a simple configuration.

DESCRIPTION OF THE PREFERRED EMBODIMENTS

Figure 1:
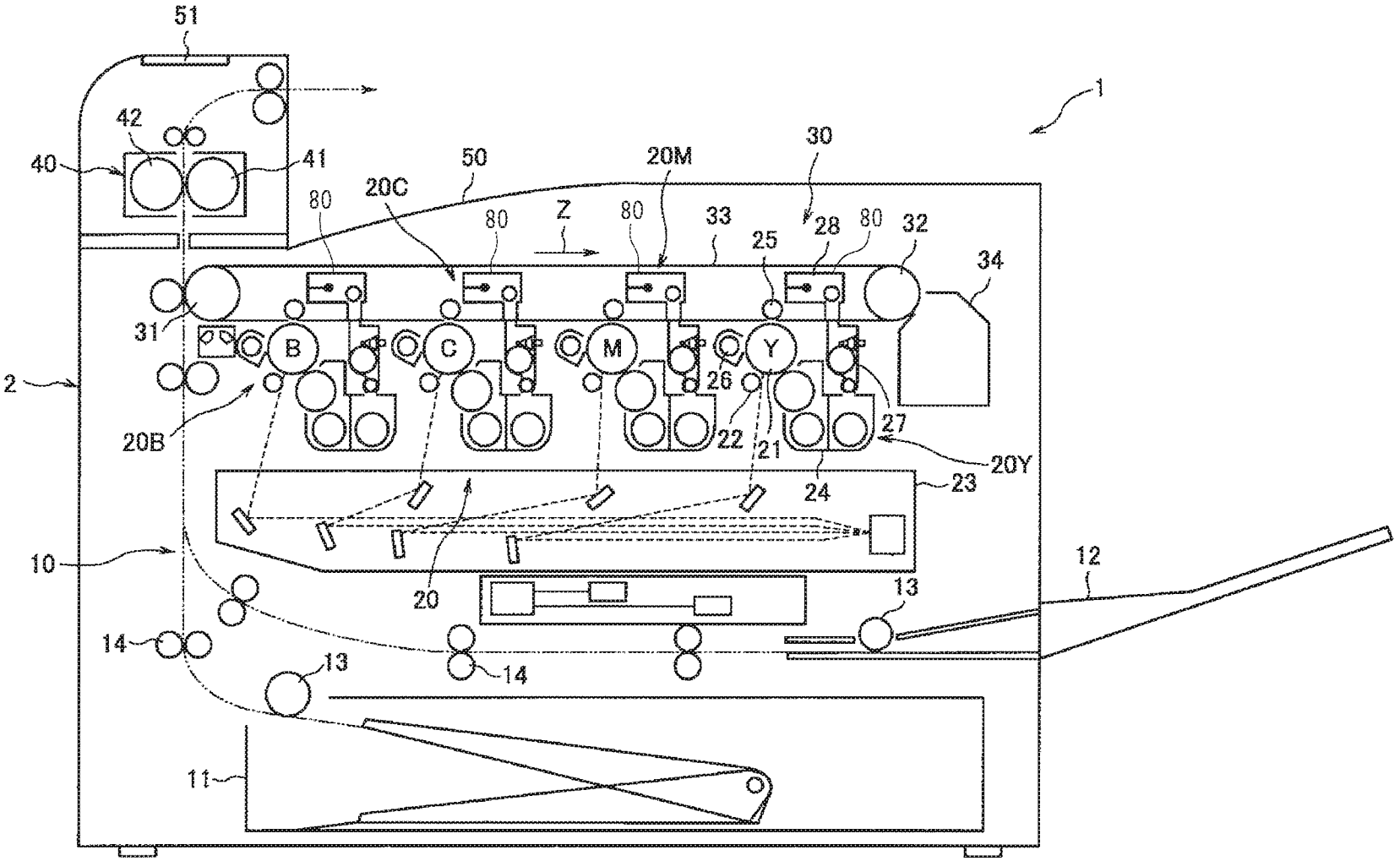
FIG. 1 is a schematic configuration view of an image forming apparatus according to an embodiment of the present invention.

Hereinafter, an embodiment according to the present invention will be described with reference to the drawings. In description below, the same reference numerals are used to represent the same components. These numerals also represent the same names and functions. Thus, detailed description thereof will not be repeated.

Figure 2:
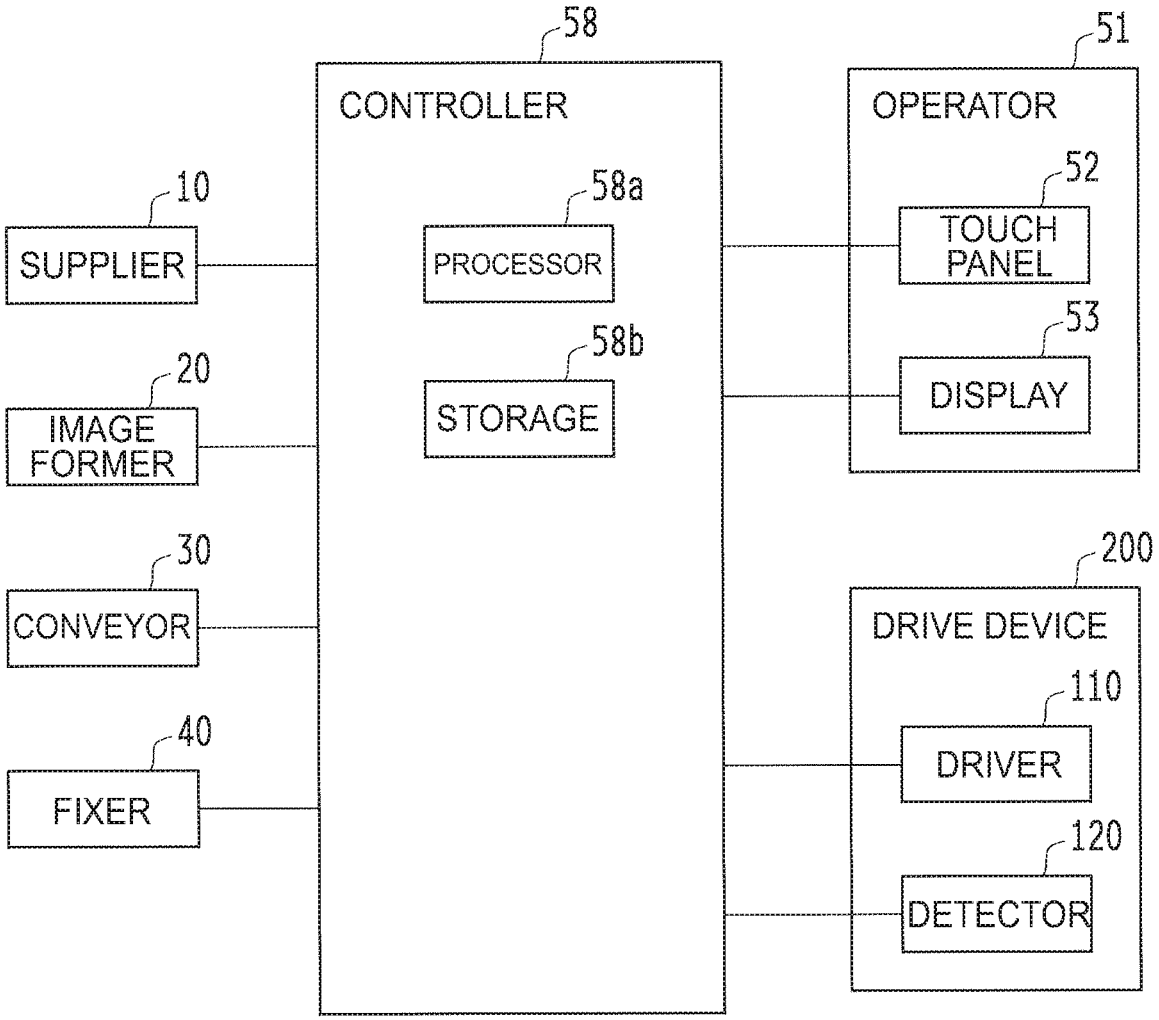
FIG. 2 is a system block diagram of the image forming apparatus illustrated in FIG. 1.

FIG. 1 is a schematic configuration view of an image forming apparatus 1 according to the embodiment of the present invention. FIG. 2 is a system block diagram of the image forming apparatus 1 illustrated in FIG. 1.

The image forming apparatus 1 can perform predetermined image processing for image data transmitted from an external device via a network, thereby outputting a color image or a black-and-white image on paper. Note that an example of a printer will be described with reference to FIGS. 1 and 2, but the image forming apparatus according to the present embodiment may be image forming apparatuses such as a copy machine which can perform predetermined image processing for image data read by, e.g., a scanner to output a color image or a black-and-white image on paper, a facsimile device, or a multifunction machine having the functions thereof.

As illustrated in FIG. 1, the image forming apparatus 1 includes, inside a box-shaped image forming apparatus body 2, a supplier 10, an image former 20, a conveyer 30, and a fixer 40, for example. The supplier 10 supplies paper to the image former 20 at predetermined timing, and the image former 20 forms a toner image on the paper.

Specifically, the supplier 10 has a paper feed tray 11 and a manual feed tray 12, and paper in the paper feed tray 11 and the manual feed tray 12 is sent to the image former 20 through a pickup roller 13 and a conveying roller 14.

For example, the image former 20 is of a tandem type, and has four stations 20Y, 20M, 20C, 20B for a yellow image, a magenta image, a cyan image, and a black image.

The yellow image station 20Y is arranged in the vicinity of a belt cleaning device 34, and the black image station 20B is arranged in the vicinity of the fixer 40. The stations 20Y, 20M, 20C, 20B for the yellow image, the magenta image, the cyan image, and the black image are arranged in this order as viewed in a movement direction of a conveying belt 33 of the conveyer 30.

Each station 20Y, 20M, 20C, 20B has the substantially same components. Thus, in FIG. 1, reference numerals are used to represent the components of the yellow image station 20Y, and reference numerals of the components of the other stations 20M, 20C, 20B are omitted. Note that in addition to the above-described four colors, e.g., light cyan (LC) and light magenta (LM) having the same hues as those of the cyan and the magenta and lower densities than those of the cyan and the magenta may be added.

The yellow image station 20Y will be described by way of example. The yellow image station 20Y has a photoconductor 21. A charging device 22, an exposure device 23, a developing device 24, a transfer roller 25, and a photoconductor cleaning device 26 are arranged in this order at the periphery of the photoconductor 21 as viewed in a rotation direction of the photoconductor 21.

The photoconductor 21 is in a cylindrical shape, and a surface thereof is made of an organic photo conductor (OPC), for example. The photoconductor 21 is rotatable in a predetermined direction by a drive device (not shown).

The charging device 22 has, for example, a roller contacting the surface of the photoconductor 21, and uniformly charges the surface of the photoconductor 21 with a predetermined polarity (e.g., a negative polarity). Note that other than the contact roller type charging device, a brush type or ion release type charging device may be used, for example.

The exposure device 23 irradiates, based on the image data, the charged surface of the photoconductor 21 with laser light, thereby forming an electrostatic latent image corresponding to the image data on the surface of the photoconductor 21. Note that other than the laser scanning device (LSU) including a laser irradiator and a reflective mirror, an exposure device such as a writing head configured such that light emitting elements such as LEDs are arranged in an array may be used.

The developing device 24 develops the electrostatic latent image formed on the surface of the photoconductor 21 with toner, thereby forming a visible image (also referred to as the toner image). The toner is supplied from a toner cartridge 28 coupled to the developing device 24, and is charged with the same polarity (e.g., the negative polarity) as that of the surface potential of the photoconductor 21. An intermediate hopper 27 which temporarily stores the toner may be, together with a carrier, housed between the toner cartridge 28 and the developing device 24.

The transfer roller 25 faces the photoconductor 21 with the conveying belt 33 being interposed therebetween. When bias voltage with the opposite polarity (e.g., a positive polarity) of the charge polarity of the toner is applied to the transfer roller 25, the toner image on the photoconductor 21 is transferred to the paper on the conveying belt 33.

The photoconductor cleaning device 26 removes the toner remaining on the surface of the photoconductor 21 after transfer to the paper. The toner removed from the photoconductor 21 is, for example, collected into the photoconductor cleaning device 26.

The conveyer 30 includes a drive roller 31, a driven roller 32, and the conveying belt 33. For example, the drive roller 31 is arranged in the vicinity of the fixer 40, and the driven roller 32 is arranged in the vicinity of the belt cleaning device 34. The conveying belt 33 is wound between the drive roller 31 and the driven roller 32. In the case of outputting the color image, when the conveying belt 33 moves in the direction of an arrow Z, the toner image in each color from each of the stations 20Y, 20M, 20C, 20B is sequentially transferred to the conveying belt 33, and thereafter, is transferred to the paper from the conveying belt 33.

The fixer 40 includes a heating roller 41 and a pressure roller 42, and at a nip portion thereof, fixes the toner image transferred to the paper. In the case of output to only a front surface of the paper, the paper sent out of the fixer 40 is discharged to a discharge tray 50.

An operator 51 is placed above the fixer 40, and as illustrated in FIG. 2, includes a liquid crystal display 53 and a transparent resistance film type touch panel 52, for example. The touch panel 52 is stacked on the display 53. The operator 51 can display a graphical user interface (GUI) for operating the image forming apparatus 1. Note that the operator 51 may have a hardware key.

The operator 51 is electrically connected to a controller 58. The controller 58 has a processor 58*a* with a microcomputer such as a central processing unit (CPU) and a storage 58*b* with a non-volatile memory such as a Read Only Memory (ROM) and a volatile memory such as a Random Access Memory (RAM). The controller 58 controls operation of various components in such a manner that the processor 58*a* loads and executes, in the RAM of the storage 58*b*, a control program stored in advance in the ROM of the storage 58*b*. Thus, the controller 58 can drivably control each component of the supplier 10, the image former 20, the conveyer 30, and the fixer 40. Moreover, the controller 58 controls drive of a drive device 200 (a drive unit) as described later.

Figure 3:
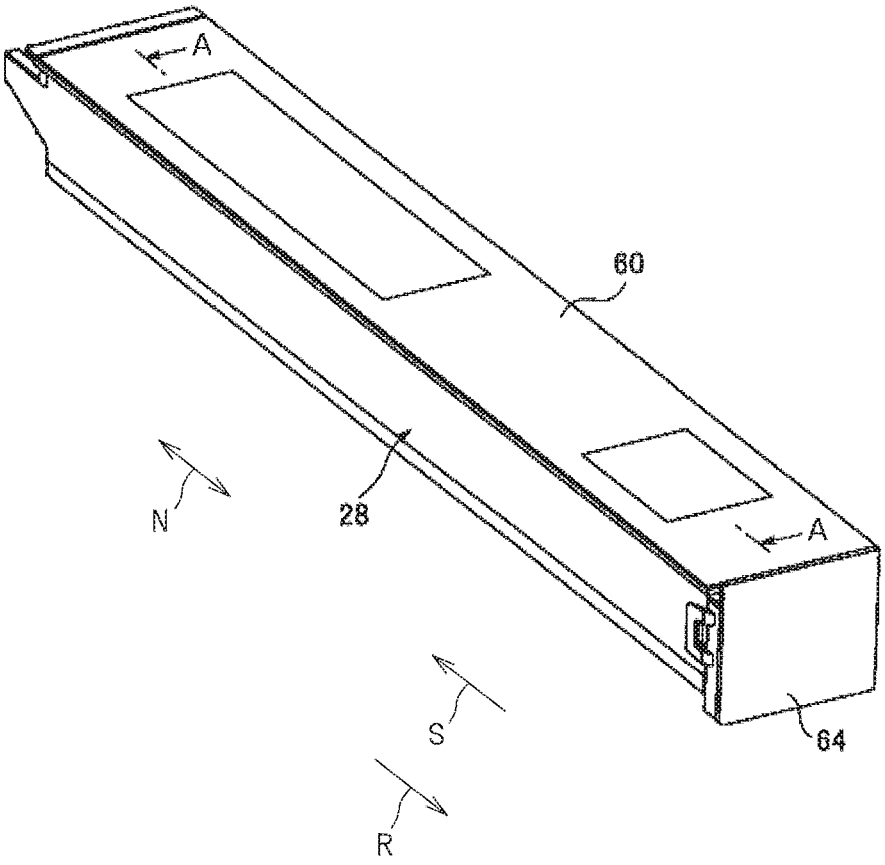
FIG. 3 is a perspective view of a toner cartridge.

FIG. 3 is a perspective view of the toner cartridge 28. As illustrated in FIG. 3, the toner cartridge 28 includes a container body 60 formed elongated along a longitudinal direction N. The toner cartridge 28 is provided for each color, and in the example described with reference to FIG. 1, the total of four toner cartridges 28 are arranged in the image forming apparatus body 2.

The image forming apparatus 1 includes the controller 58 and the drive devices 200. In the image forming apparatus body 2, the total of four cartridge housing portions 80 (see FIG. 1) each corresponding to the toner cartridges 28 for each color are placed. On a far side of each cartridge housing portion 80, the drive device 200 for each toner cartridge 28 is placed.

A front cover 64 of the toner cartridge 28 is positioned at an upstream side end surface of the toner cartridge 28 in an insertion direction S thereof. The toner cartridge 28 can be inserted into or detached from the cartridge housing portion 80 along the longitudinal direction N. The toner cartridge 28 is inserted into the cartridge housing portion 80 in the insertion direction S with the side of the toner cartridge 28 opposite to the front cover 64 being on a leading side. In this manner, the toner cartridge 28 is coupled to the drive device 200 positioned on the far side. With this configuration, the toner cartridge 28 can mix and convey the toner in the container body 60 with a driving force (rotary driving force) of a driver 110 (a drive motor acting as a rotary driver) of the drive device 200.

On the other hand, the toner cartridge 28 is detached from the cartridge housing portion 80 in a detachment direction R with the front cover 64 being on the leading side, and accordingly, retracts from the drive device 200. In this manner, the toner cartridge 28 can be pulled out of the cartridge housing portion 80.

Figure 4:
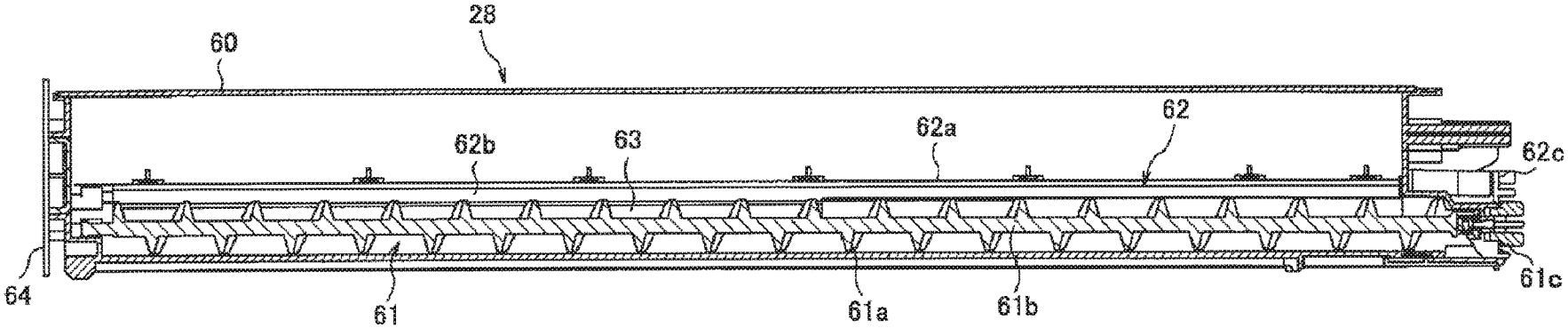
FIG. 4 is a sectional view of the toner cartridge illustrated in FIG. 3 from an arrow of an A-A line.

FIG. 4 is a sectional view of the toner cartridge 28 illustrated in FIG. 3 from an arrow of an A-A line. As illustrated in FIG. 4, a toner conveying member 61 and a mixing member 62 are arranged next to each other in the container body 60 of the toner cartridge 28, for example.

The toner conveying member 61 has a rotary shaft 61*b*, a screw 61*a* provided around the rotary shaft 61*b*, and a drive transmission member 61*c* provided at a tip end of the rotary shaft 61*b*. The toner conveying member 61 is coupled to the drive device 200 via the drive transmission member 61*c* on the outside of the container body 60, and is rotatable in a predetermined direction with the driving force of the driver 110 of the drive device 200.

The mixing member 62 has, for example, a sheet 62*a* made of a material such as PET, a rotary shaft 62*b*, and a drive transmission member 62*c*. The sheet 62*a* is, for example, formed in a flexible thin plate shape contactable with an inner surface of the container body 60. As in the toner conveying member 61, the mixing member 62 is coupled to the drive device 200 via the drive transmission member 62*c* on the outside of the container body 60, and is rotatable in a predetermined direction with the driving force of the driver 110 of the drive device 200. A partition wall 63 stands between the toner conveying member 61 and the mixing member 62.

In the toner cartridge 28, the toner mixed by the mixing member 62 reaches the periphery of the toner conveying member 61 beyond the partition wall 63. The toner collected to the periphery of the toner conveying member 61 is conveyed by the toner conveying member 61 to move toward the intermediate hopper 27 (see FIG. 1).

Toner Cartridge Extrusion Device

First Embodiment

Figure 5A:
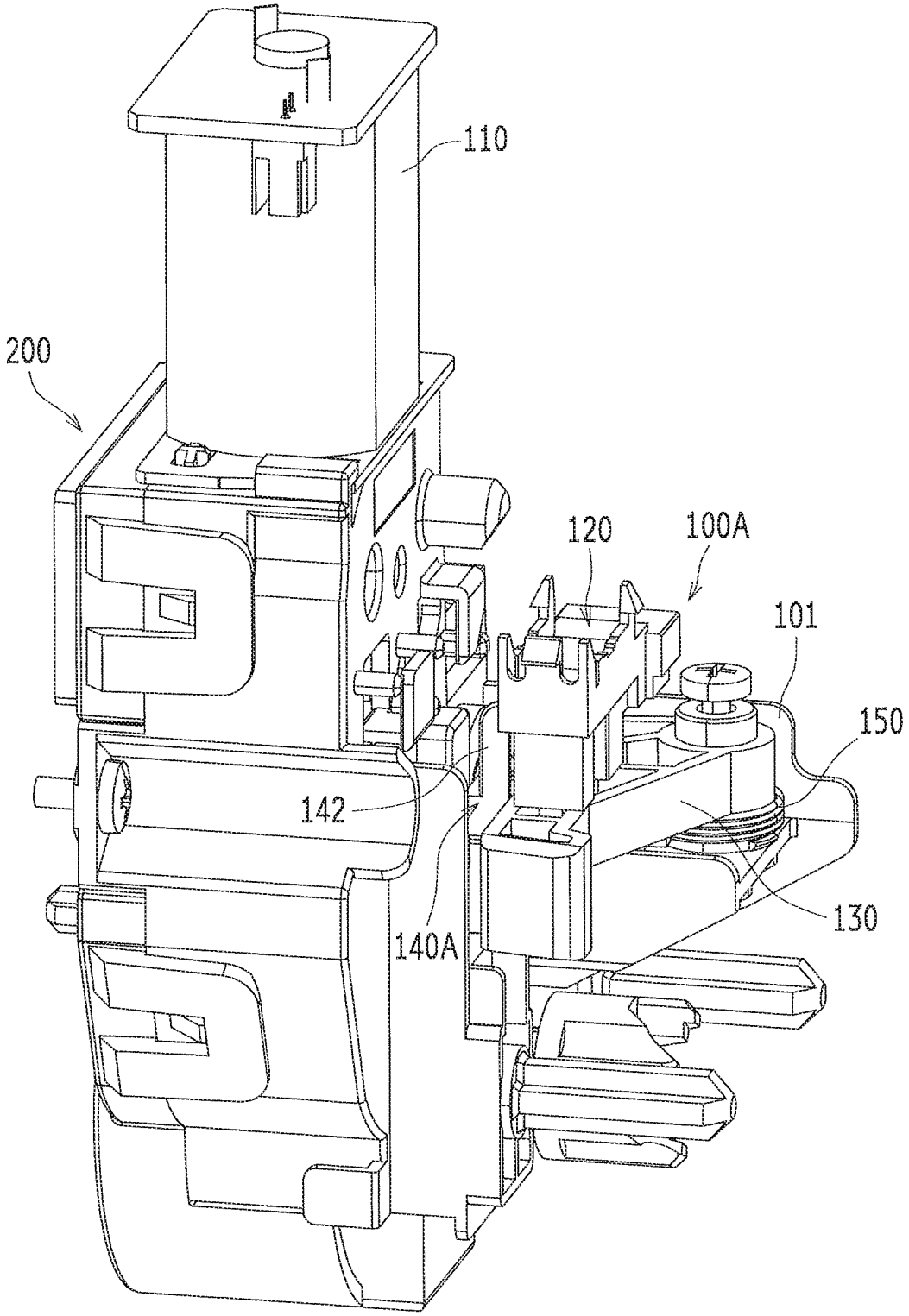
FIG. 5A is a perspective view of a left side surface of a drive device including a toner cartridge extrusion device according to a first embodiment diagonally from an upper front side.
Figure 5B:
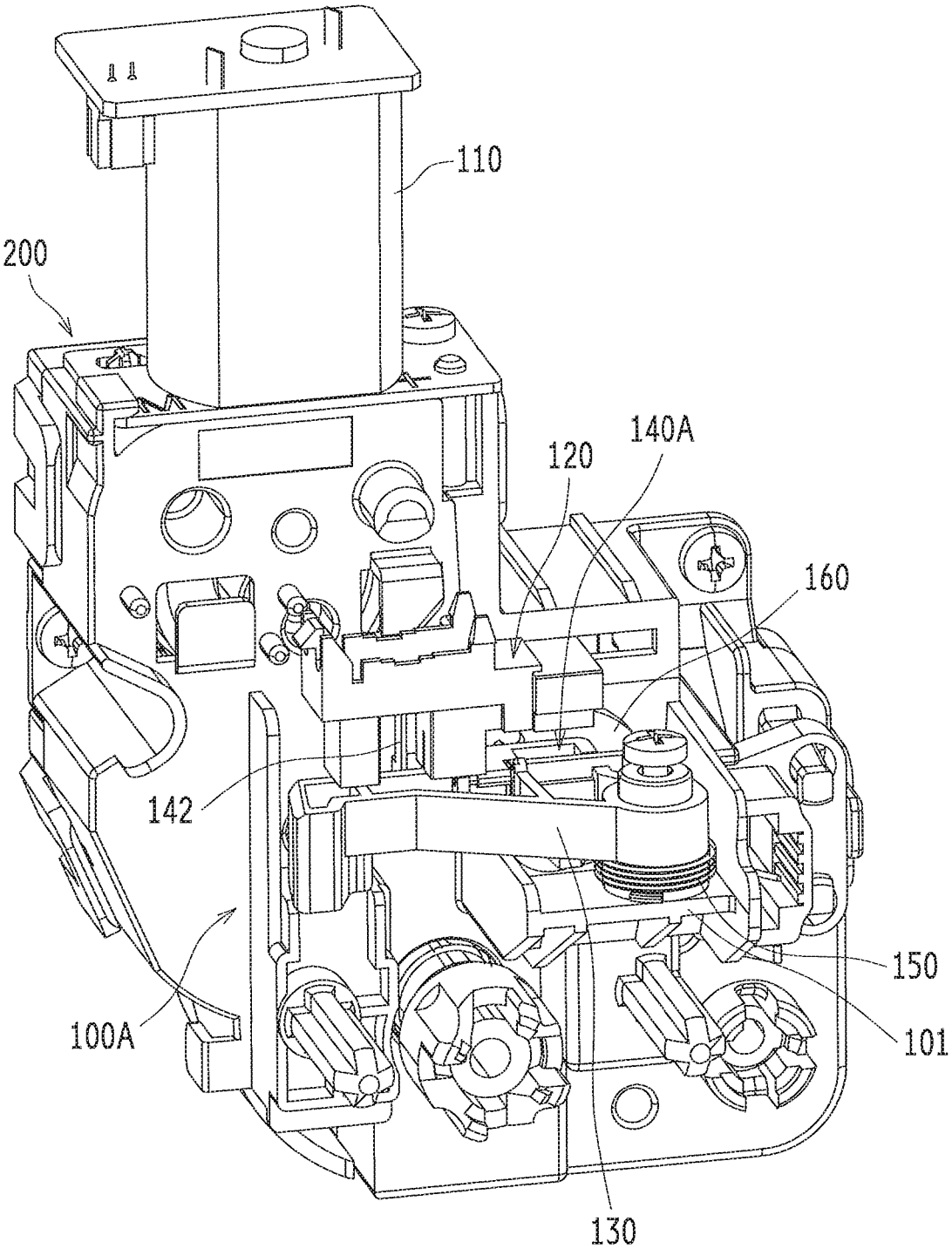
FIG. 5B is a perspective view of a front side surface of the drive device including the toner cartridge extrusion device according to the first embodiment diagonally from an upper left side.

FIG. 5A is a perspective view of a left side surface of a drive device 200 including a toner cartridge extrusion device 100A according to a first embodiment diagonally from an upper front side. FIG. 5B is a perspective view of a front side surface of the drive device 200 including the toner cartridge extrusion device 100. A according to the first embodiment diagonally from an upper left side.

Figure 6A:
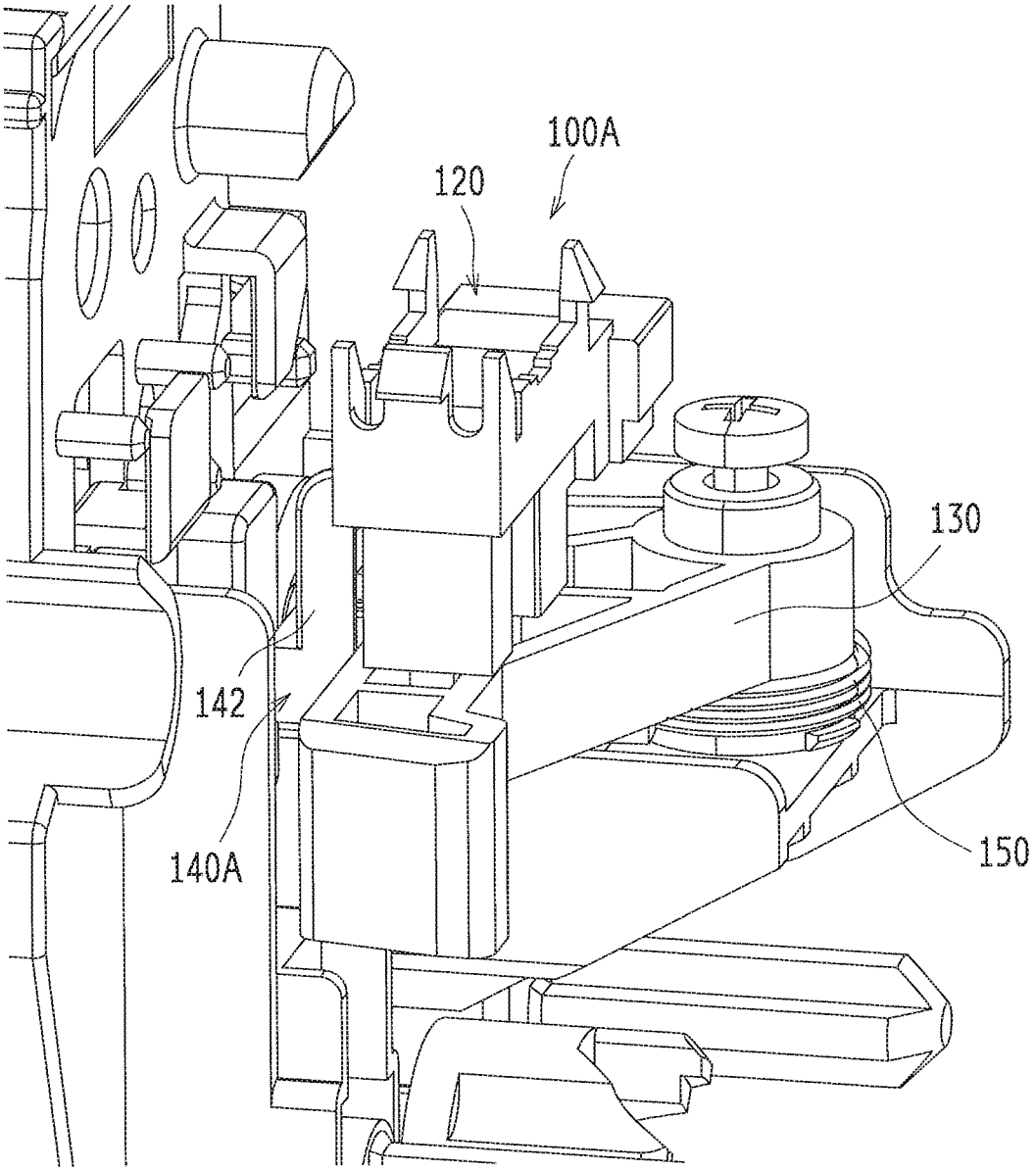
FIG. 6A is a perspective view of a toner cartridge extrusion device portion illustrated in FIG. 5A.
Figure 6B:
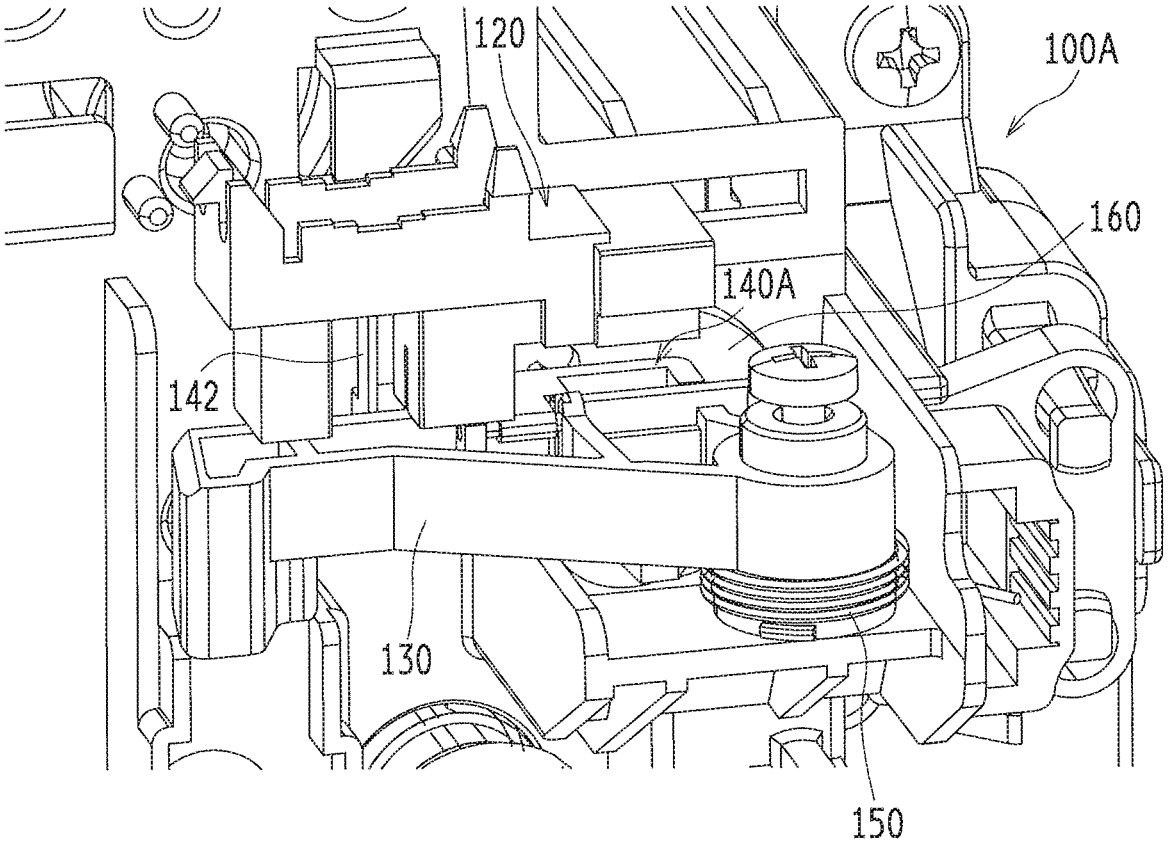
FIG. 6B is a perspective view of a toner cartridge extrusion device portion illustrated in FIG. 5B.
Figure 7A:
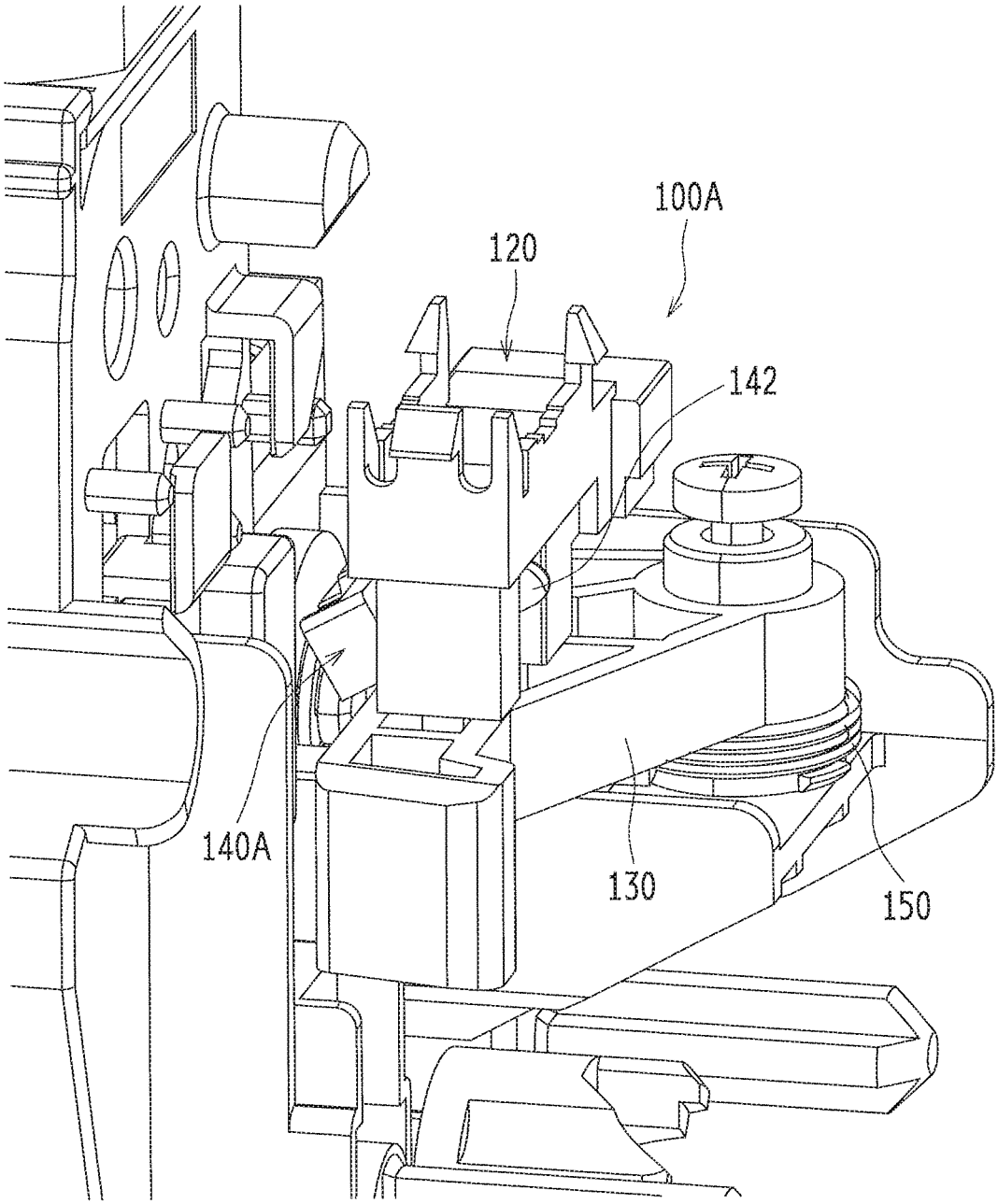
FIG. 7A is a perspective view of the toner cartridge extrusion device portion illustrated in FIG. 5A.
Figure 7B:
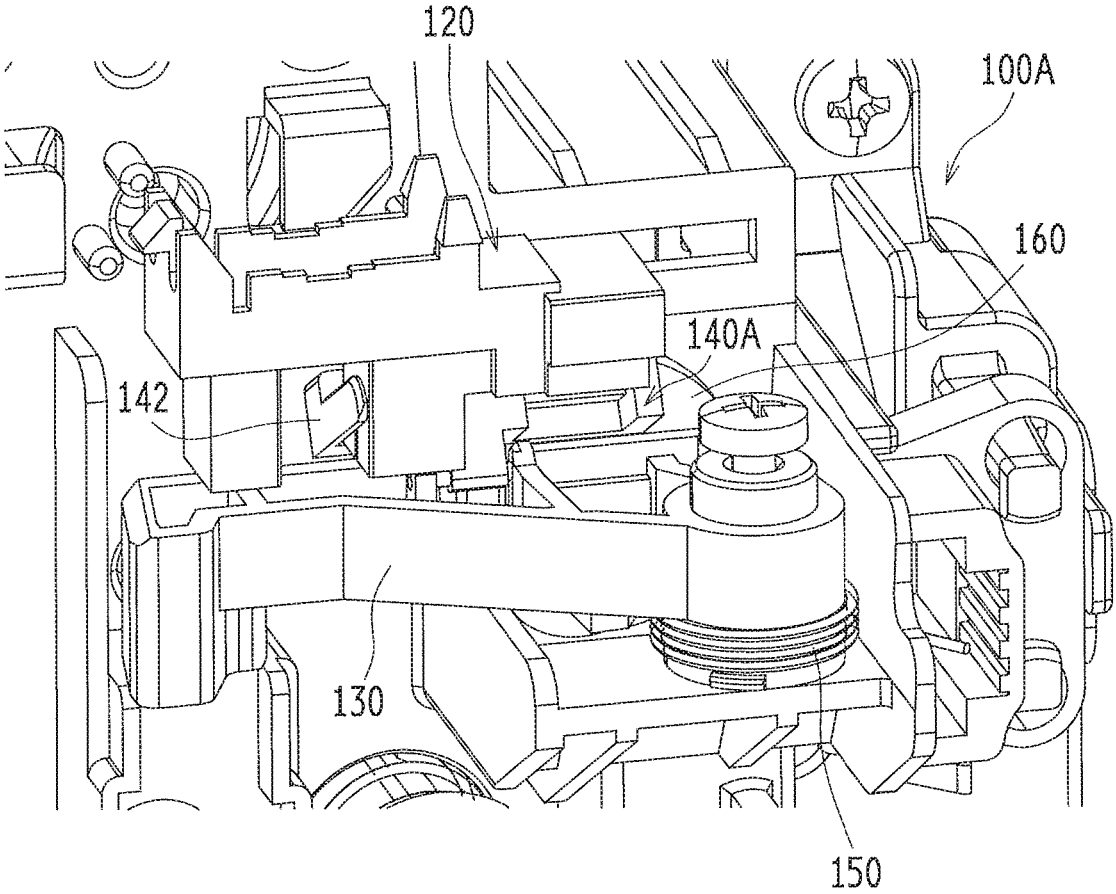
FIG. 7B is a perspective view of the toner cartridge extrusion device portion illustrated in FIG. 5B.
Figure 8A:
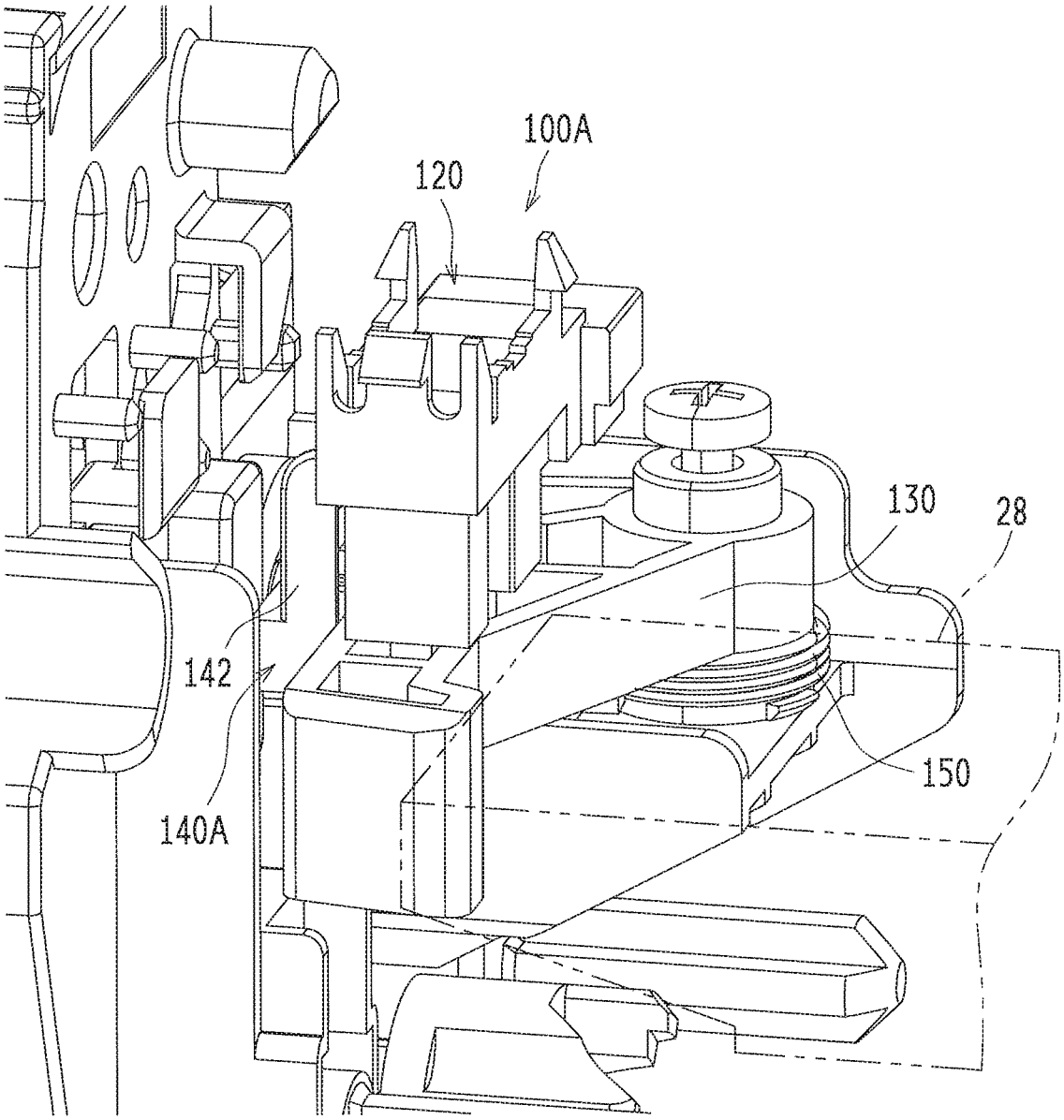
FIG. 8A is a perspective view of the toner cartridge extrusion device portion illustrated in FIG. 5A.
Figure 8B:
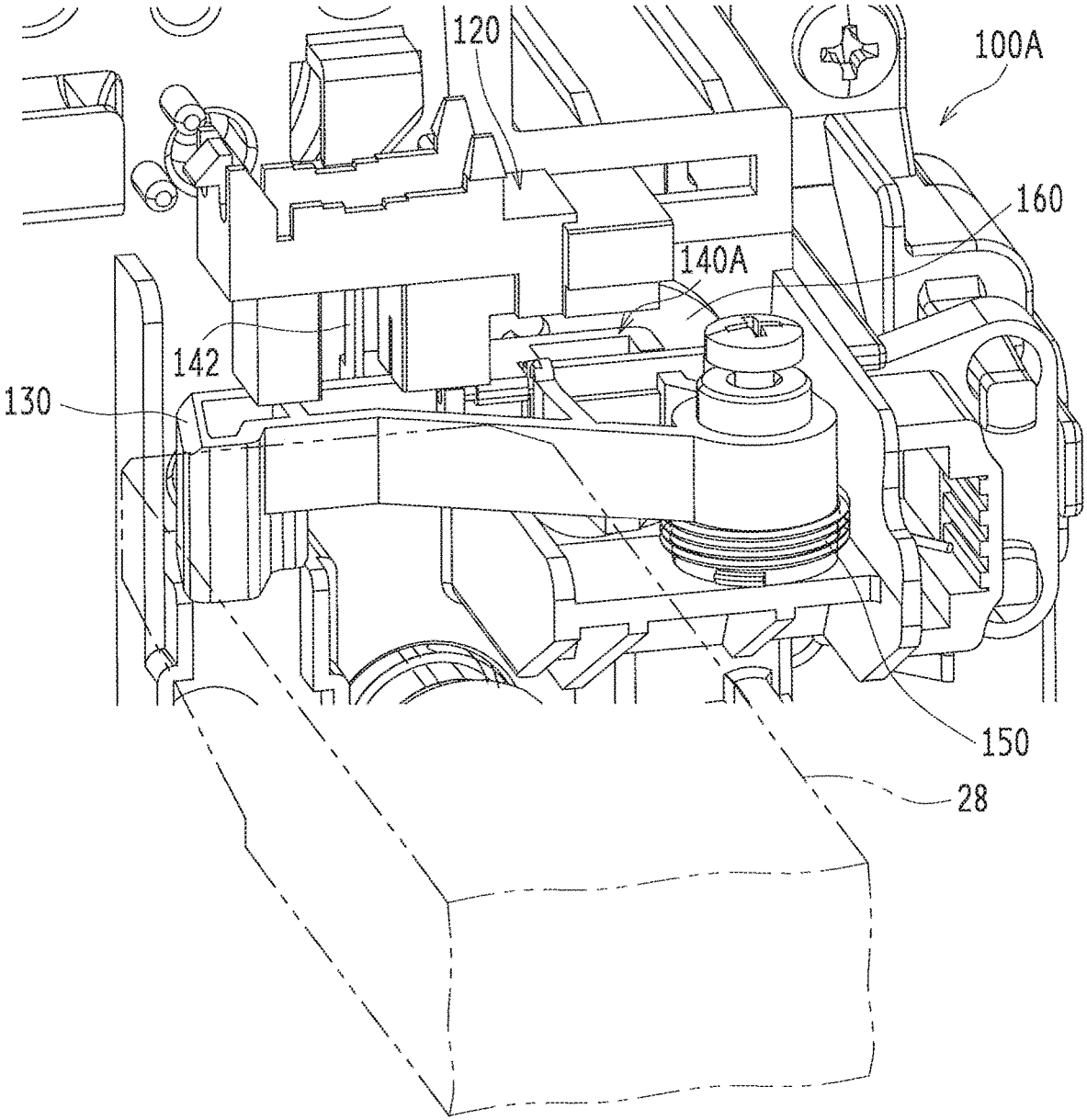
FIG. 8B is a perspective view of the toner cartridge extrusion device portion illustrated in FIG. 5B.
Figure 9A:
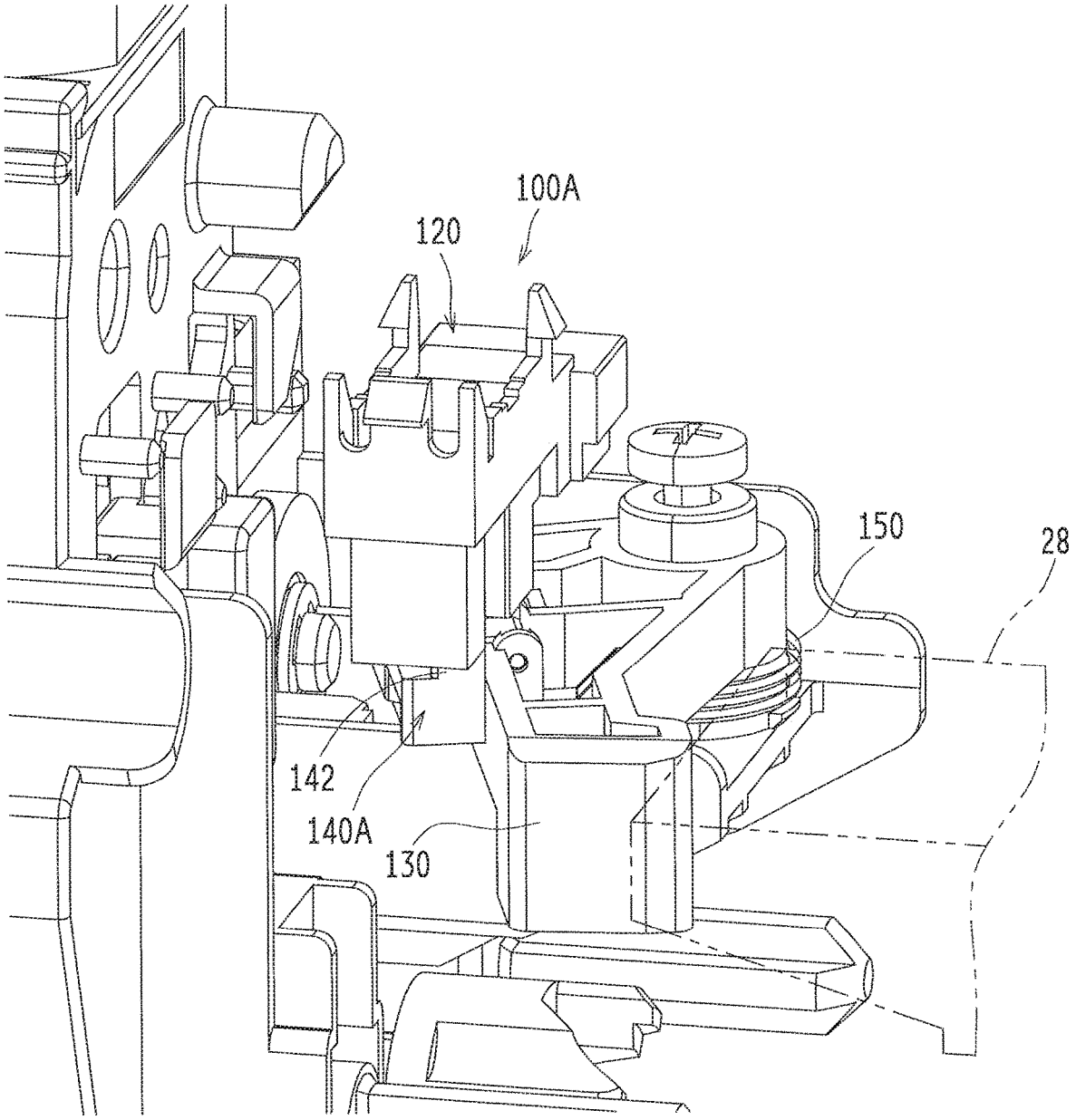
FIG. 9A is a perspective view of the toner cartridge extrusion device portion illustrated in FIG. 5A.
Figure 9B:
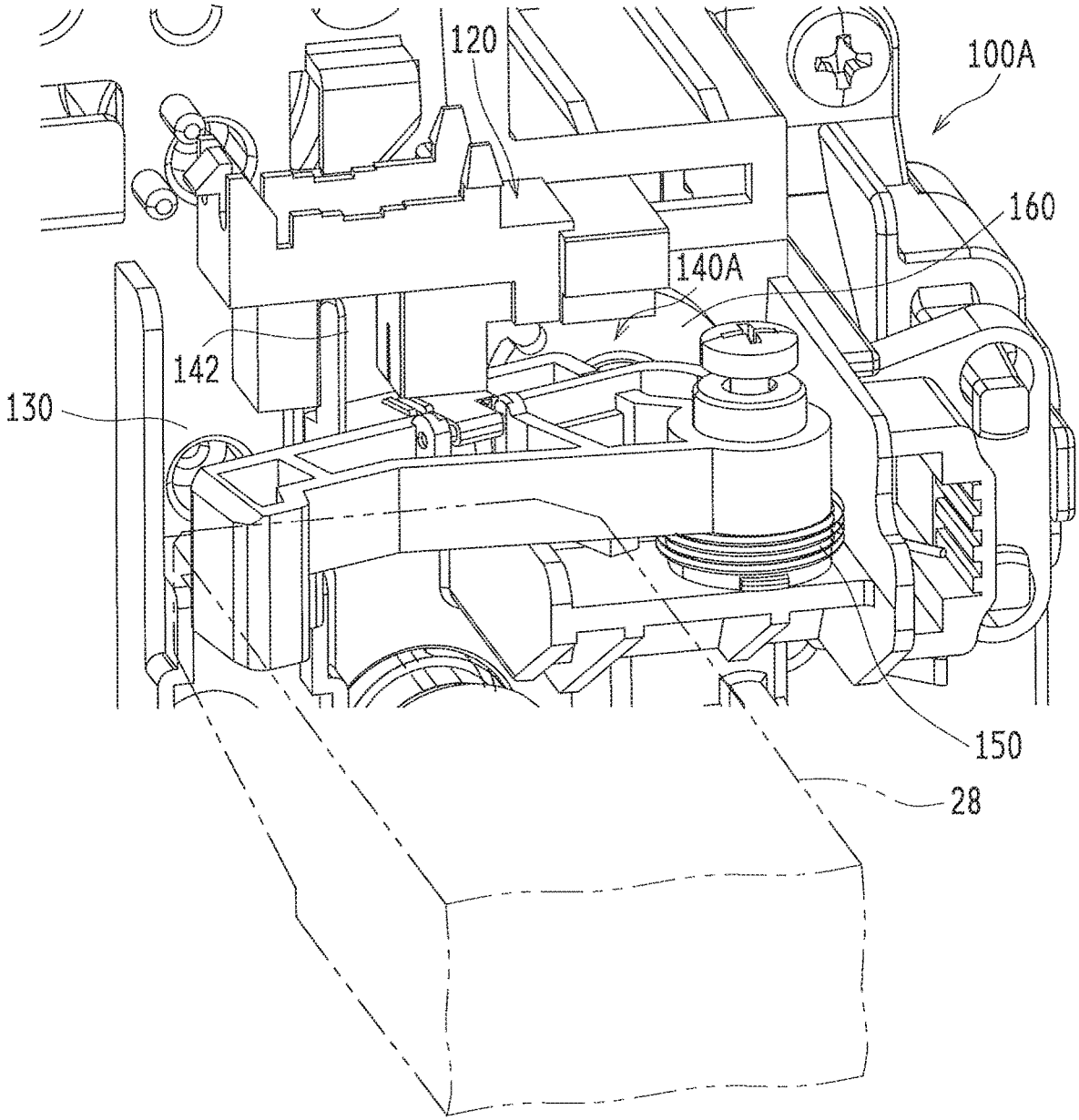
FIG. 9B is a perspective view of the toner cartridge extrusion device portion illustrated in FIG. 5B.

FIGS. 6A, 7A, 8A, and 9A are perspective views of a portion as the toner cartridge extrusion device 100A illustrated in FIG. 5A. FIGS. 6B, 7B, 8B, and 9B are perspective views of a portion as the toner cartridge extrusion device 100A illustrated in FIG. 5B. FIGS. 6A and 6B illustrate a state in which a detector 120 is OFF during drive detection. FIGS. 7A and 7B illustrate a state in which the detector 120 is ON during drive detection. FIGS. 8A and 8B illustrate a state in which the detector 120 is OFF during extrusion detection. FIGS. 9A and 9B illustrate a state in which the detector 120 is ON during extrusion detection.

The drive device 200 according to the first embodiment includes the toner cartridge extrusion device 100A which extrudes a toner cartridge 28 with a driving force of a driver 110.

The toner cartridge extrusion device 100A performs, by the single detector 120 drive detection to detect drive of the driver 110 and extrusion detection to detect whether or not the toner cartridge 28 has been extruded.

According to the present embodiment, drive detection to detect drive of the driver 110 and extrusion detection to detect whether or not the toner cartridge 28 has been extruded are performed by the single detector 120. Thus, drive detection for the driver 110 and extrusion detection for the toner cartridge 28 can be easily performed without the need for providing detectors only for drive detection for the driver 110 and only for extrusion detection for the toner cartridge 28. Thus, drive detection for the driver 110 and extrusion detection for the toner cartridge 28 can be implemented with a simple configuration.

In the first embodiment, the toner cartridge extrusion device 100A includes the driver 110 and the single detector 120. The driver 110 is a rotary driver (110) which extrudes the toner cartridge 28 with a rotary driving force. Drive detection is rotation detection for the rotary driver (110). With this configuration, the rotary driving force of the rotary driver (110) can be utilized to easily perform rotation detection for the rotary driver (110) and extrusion detection for the toner cartridge 28 by the single detector 120.

In the first embodiment, the rotary driver (110) is a toner motor which supplies toner in the toner cartridge 28 to a developing device 24. With this configuration, in a case where the toner in the toner cartridge 28 is supplied to the developing device 24 by the toner motor (110) acting as a drive motor, rotation detection for the toner motor (110) and extrusion detection for the toner cartridge 28 can be easily performed by the single detector 120.

In the first embodiment, rotation detection by the single detector 120 is detection of the number of rotations of the toner motor (110). With this configuration, detection of the amount of toner supplied from the toner cartridge 28 to the developing device 24 can be performed based on detection of the number of rotations of the toner motor (110) by the single detector 120 shared for extrusion detection for the toner cartridge 28.

In the first embodiment, the toner cartridge extrusion device 100A includes an arm member 130 and a movement member 140A (a rotary movement member). The arm member 130 extrudes the toner cartridge 28 with the driving force of the driver 110. The movement member 140A is moved by the driving force of the driver 110. A detector target 142 to be detected by the single detector 120 is provided at the movement member 140A. The movement member 140A is provided at the arm member 130. The single detector 120 performs drive detection by movement operation of the movement member 140A while performing extrusion detection by extrusion operation of the arm member 130.

With this configuration, the single detector 120 can perform drive detection for the driver 110 in the movement operation of the movement member 140A. Moreover, the single detector 120 can perform extrusion detection for the toner cartridge 28 in the extrusion operation of the arm member 130. Thus, drive detection for the driver 110 and extrusion detection for the toner cartridge 28 performed by the single detector 120 can be implemented with a simple configuration.

Drive Detection for Driver

In the first embodiment, the arm member 130 is movable between an extrusion position (a position in FIGS. 9A and 9B) at which the toner cartridge 28 is extruded and a retraction position (a position in FIGS. 5A to 8B) at which the toner cartridge 28 retracts from the extrusion position. The movement member 140A is movable such that the detector target is displaced between a first detection position (a position in FIGS. 7A and 7B) at which the detector target 142 is detected by the single detector 120 and a first non-detection position (a position in FIGS. 5A to 6B) at which the detector target is not detected by the single detector. With this configuration, the single detector 120 can perform drive detection for the driver 110 (the rotary driver) by detecting the presence or absence of the detector target 142 displaced between the first detection position and the first non-detection position.

Extrusion Detection for Toner Cartridge

Moreover, the retraction position (the position in FIGS. 8A and 8B) of the arm member 130 is a second non-detection position at which the detector target 142 is not detected by the single detector 120. Moreover, the extrusion position (the position in FIGS. 9A and 9B) of the arm member 130 is a second detection position at which the detector target 142 is detected by the single detector 120. Note that the retraction position of the arm member 130 may be the second detection position, and the extrusion position of the arm member 130 may be the second non-detection position.

With this configuration, the single detector 120 can perform extrusion detection for the toner cartridge 28 by detecting the presence or absence of the detector target 142 moved between the second detection position and the second non-detection position. Upon extrusion detection for the toner cartridge 28, the movement member 140A is at a predetermined position (e.g., the first detection position or the first non-detection position, and the first non-detection position in this example).

With this configuration, drive detection for the driver 110 and extrusion detection for the toner cartridge 28 can be reliably performed by the single detector 120.

Detailed Configuration.

Specifically, the toner cartridge extrusion device 100A further includes a biasing member (a first biasing member 150) and a cam member 160.

Figure 10:
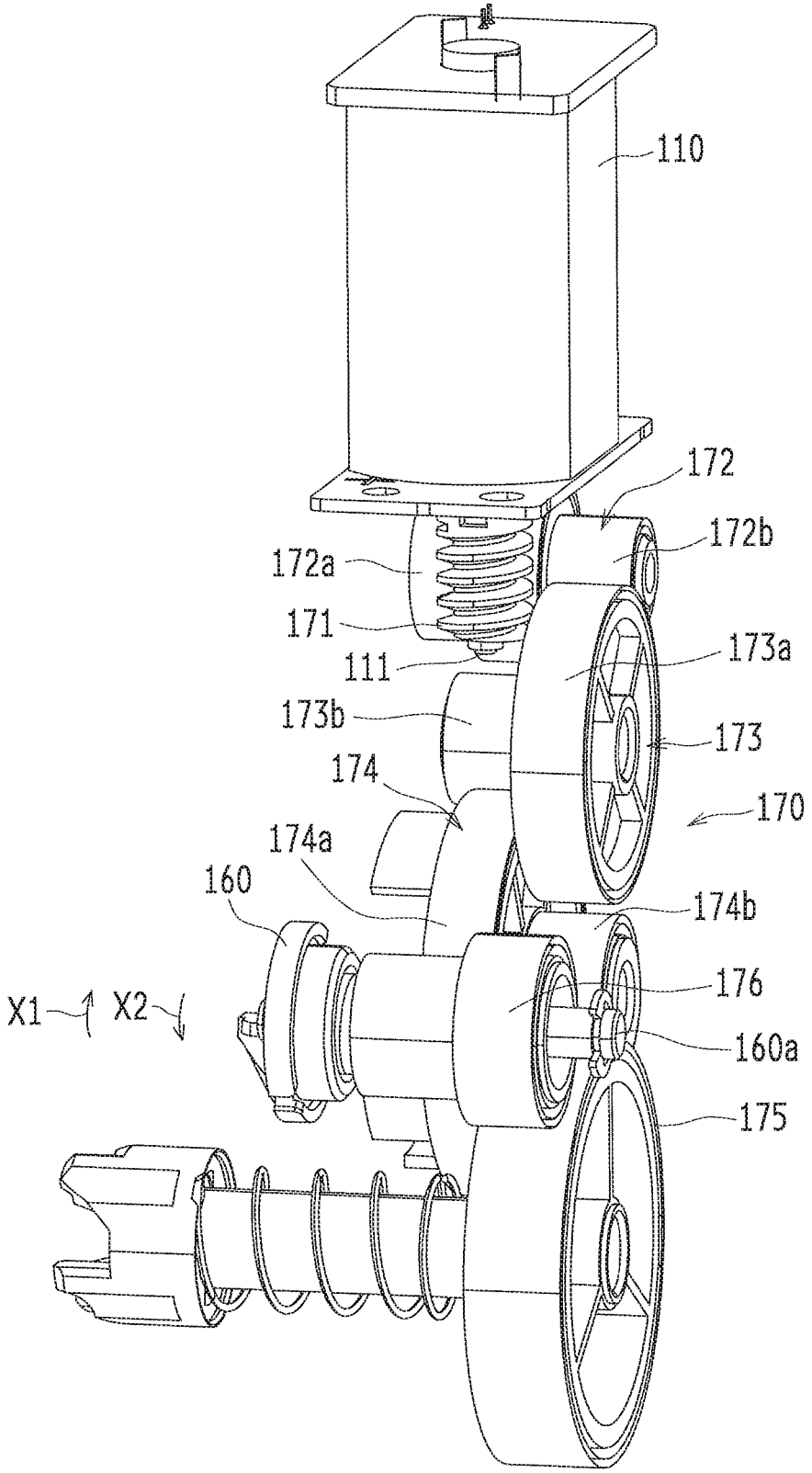
FIG. 10 is a perspective view of a left side surface of a drive system in the drive device of the toner cartridge extrusion device according to the first embodiment diagonally from an upper back side.

FIG. 10 is a perspective view of a left side surface of a drive system in the drive device 200 including the toner cartridge extrusion device 100A according to the first embodiment diagonally from an upper back side.

As illustrated in FIG. 10, the toner cartridge extrusion device 100A includes the driver 110 and a drive transmitter 170 which transmits the driving force from the driver 110 to the cam member 160.

The driver 110 is electrically connected to an output system of the controller 58 (see FIG. 2). The drive transmitter 170 forms a gear train including multiple gears. Note that the drive transmitter 170 may include a drive belt. The drive transmitter 170 includes a first gear 171 to a sixth gear 176. The first gear 171 includes a helical gear, and is fixed to a rotary shaft 111 of the driver 110. The first gear 171 engages with a large-diameter gear 172*a* of the second gear 172. A small-diameter gear 172*b* of the second gear 172 engages with a large-diameter gear 173*a* of the third gear 173. A small-diameter gear 173*b* of the third gear 173 engages with a large-diameter gear 174*a* of the fourth gear 174. A small-diameter gear 174*b* of the fourth gear 174 engages with the fifth gear 175. Moreover, the sixth gear 176 is fixed to a rotary shaft 160*a* of the cam member 160, and engages with the fifth gear 175. Thus, the controller 58 rotatably controls the driver 110 so that the cam member 160 can rotate in a first rotation direction X1 and a second rotation direction X2 opposite to the first rotation direction X1.

FIGS. 11A to 11C and FIGS. 13A to 13C are perspective views of back side surfaces of the detector 120, the arm member 130, the movement member 140A, the first biasing member 150, and the cam member 160 diagonally from an upper left side. FIGS. 12A to 12C and FIGS. 14A to 14C are perspective views of left side surfaces of the arm member 130, the movement member 140A, the first biasing member 150, and the cam member 160 diagonally from an upper front side.

Drive Detection for Driver

In a state in which the arm member 130 is at the retraction position, the cam member 160 moves, with the rotary driving force of the rotary driver (110) in the first rotation direction X1, the movement member such that the detector target 142 is alternately displaced between the first detection position and the first non-detection position.

Figure 11A:
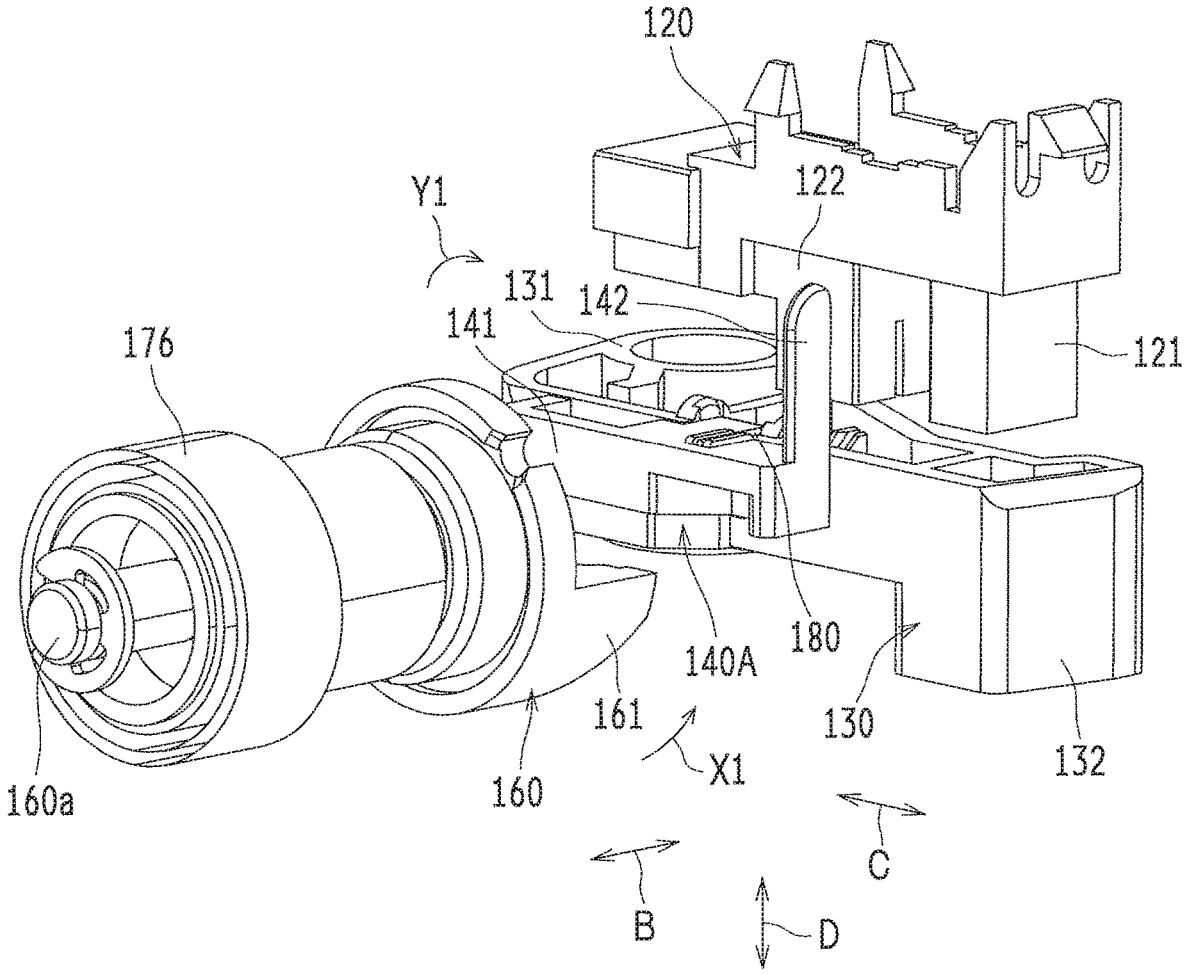
FIG. 11A is a perspective view of back side surfaces of a detector, an arm member, a movement member, a first biasing member, and a cam member diagonally from an upper left side.
Figure 12A:
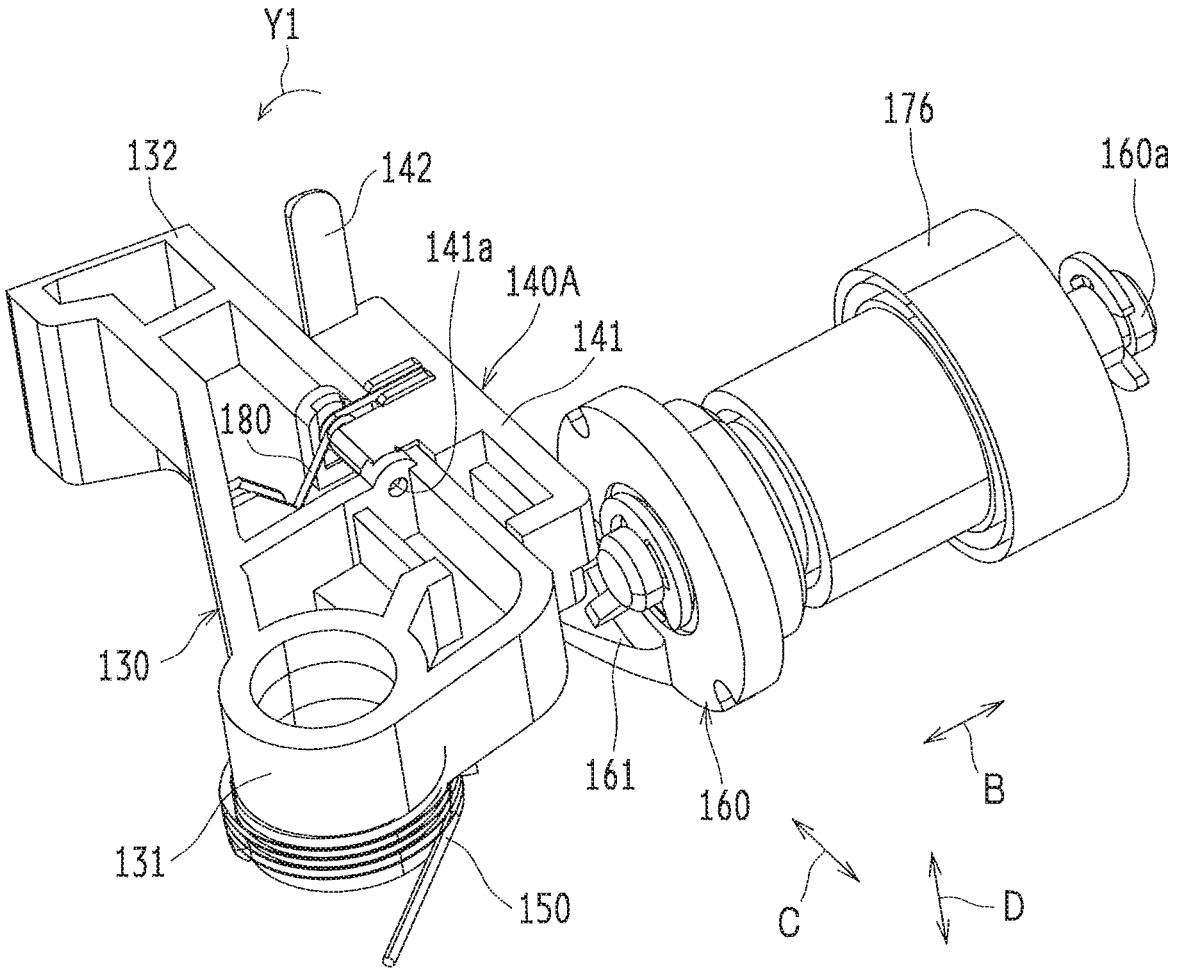
FIG. 12A is a perspective view of left side surfaces of the arm member, the movement member, the first biasing member, and the cam member diagonally from an upper front side.

Specifically, in the case of performing drive detection, when the cam member 160 is at an initial position, the detector target 142 is at the first non-detection position, and therefore, the detector 120 is OFF, as illustrated in FIGS. 11A and 12A. Note that the initial position of the cam member 160 can be brought by detecting predetermined rotation positions of the cam member 160 and the first gear 171 to the sixth gear 176.

Figure 11B:
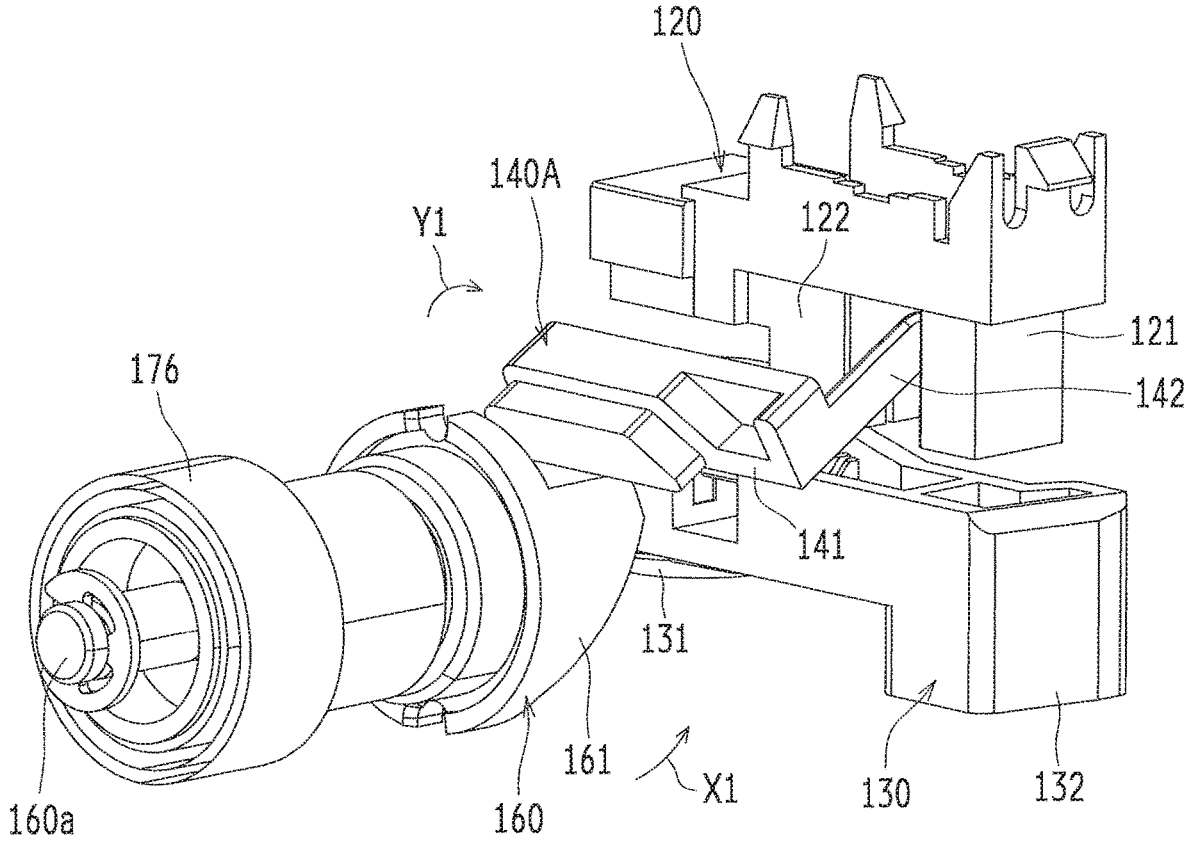
FIG. 11B is a perspective view of the back side surfaces of the detector, the arm member, the movement member, the first biasing member, and the cam member diagonally from the upper left side.
Figure 12B:
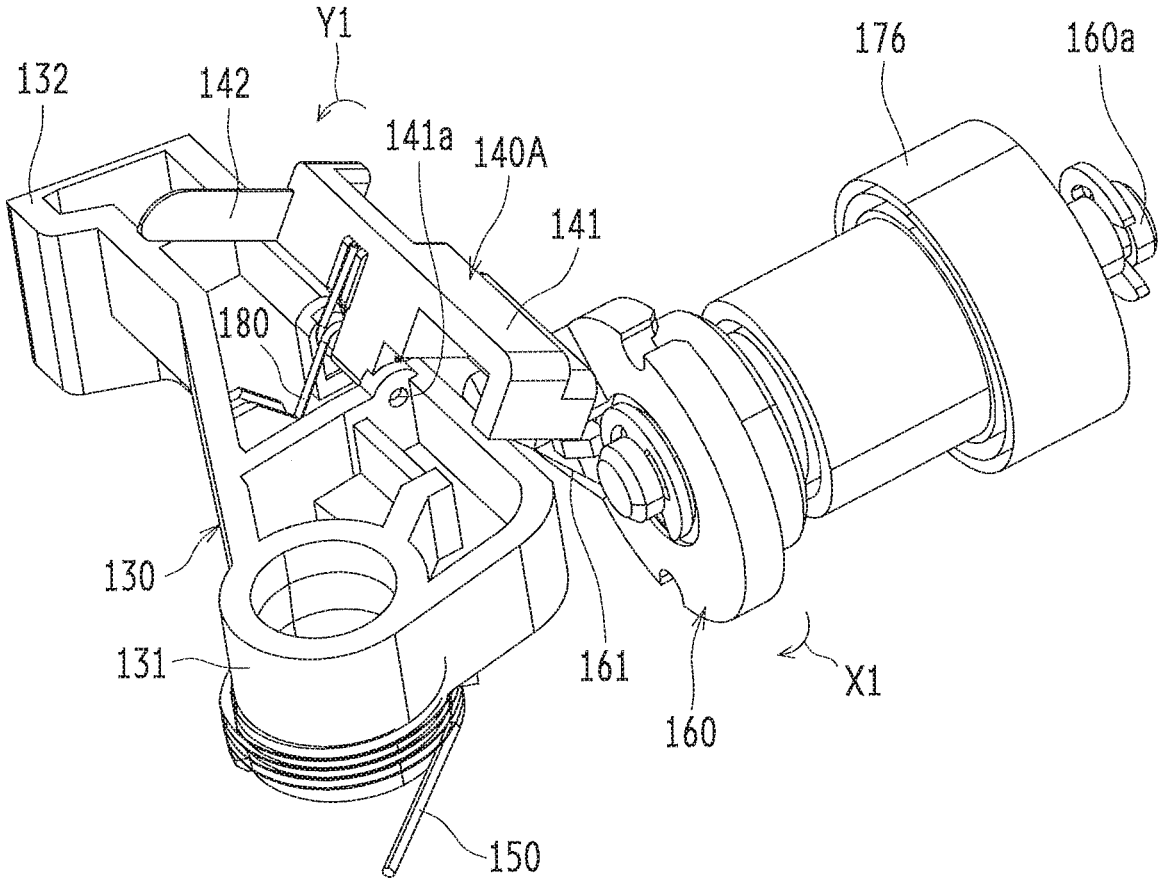
FIG. 12B is a perspective view of the left side surfaces of the arm member, the movement member, the first biasing member, and the cam member diagonally from the upper front side.

When the cam member 160 rotates from the initial position in the first rotation direction X1, the movement member 140A moves (rotatably moves in a first rotary movement direction Y1) to bring the detector target 142 to the first detection position, and accordingly, the detector 120 is turned on as illustrated in FIGS. 11B and 12B.

Figure 11C:
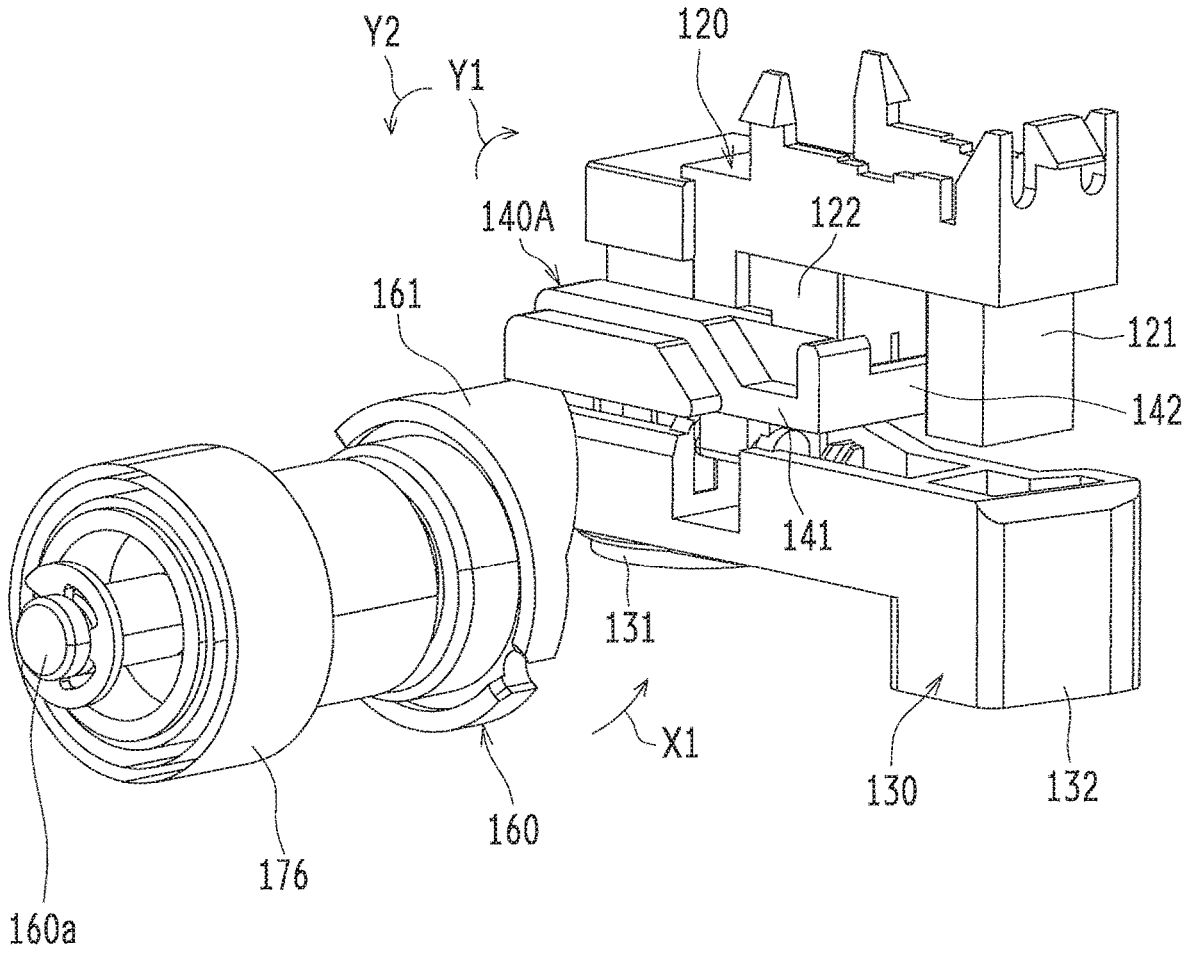
FIG. 11C is a perspective view of the back side surfaces of the detector, the arm member, the movement member, the first biasing member, and the cam member diagonally from the upper left side.
Figure 12C:
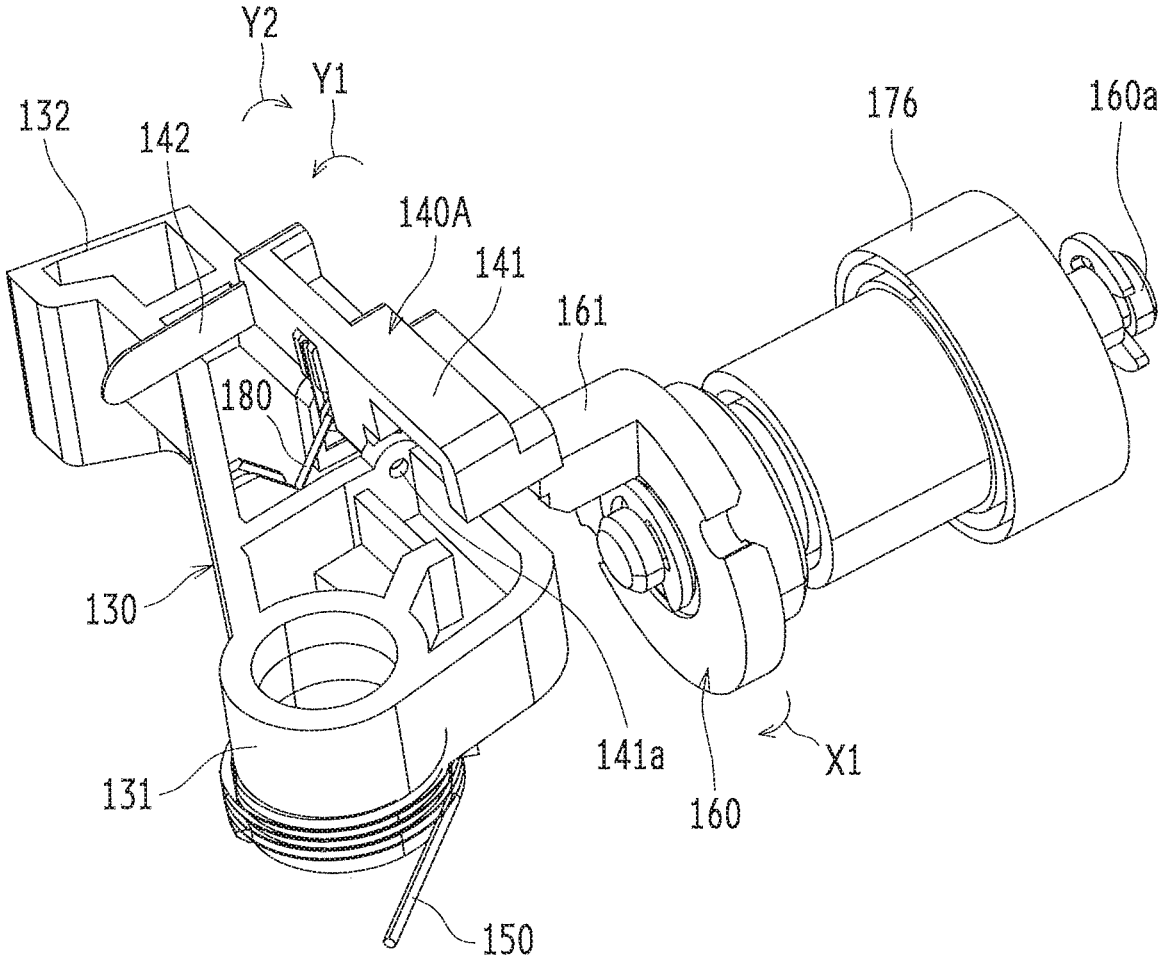
FIG. 12C is a perspective view of the left side surfaces of the arm member, the movement member, the first biasing member, and the cam member diagonally from the upper front side.

When the cam member 160 further rotates from the first detection position in the first rotation direction X1, the detector target 142 of the movement member 140A further moves (rotatably moves in the first rotary movement direction Y1) to a position right before cancellation of operation of the movement member 140A by the cam member 160, and accordingly, the detector 120 is turned on as illustrated in FIGS. 11C and 12C. When the cam member 160 further rotates in the first rotation direction X1, operation of the movement member 140A by the cam member 160 is canceled. Accordingly, as illustrated in FIGS. 11A and 12A, the movement member 140A rotatably moves in a second rotary movement direction Y2 opposite to the first rotary movement direction Y1. To return to the initial position, thereby turning off the detector 120.

Extrusion Detection for Toner Cartridge

The biasing member (the first biasing member 150) biases the arm member 130 to a retraction position side as the second non-detection position. The cam member 160 extrudes, with the rotary driving force of the rotary driver (110) in the second rotation direction X2, the arm member 130 to the extrusion position as the second detection position against biasing force of the biasing member (the first biasing member 150).

Figure 13A:
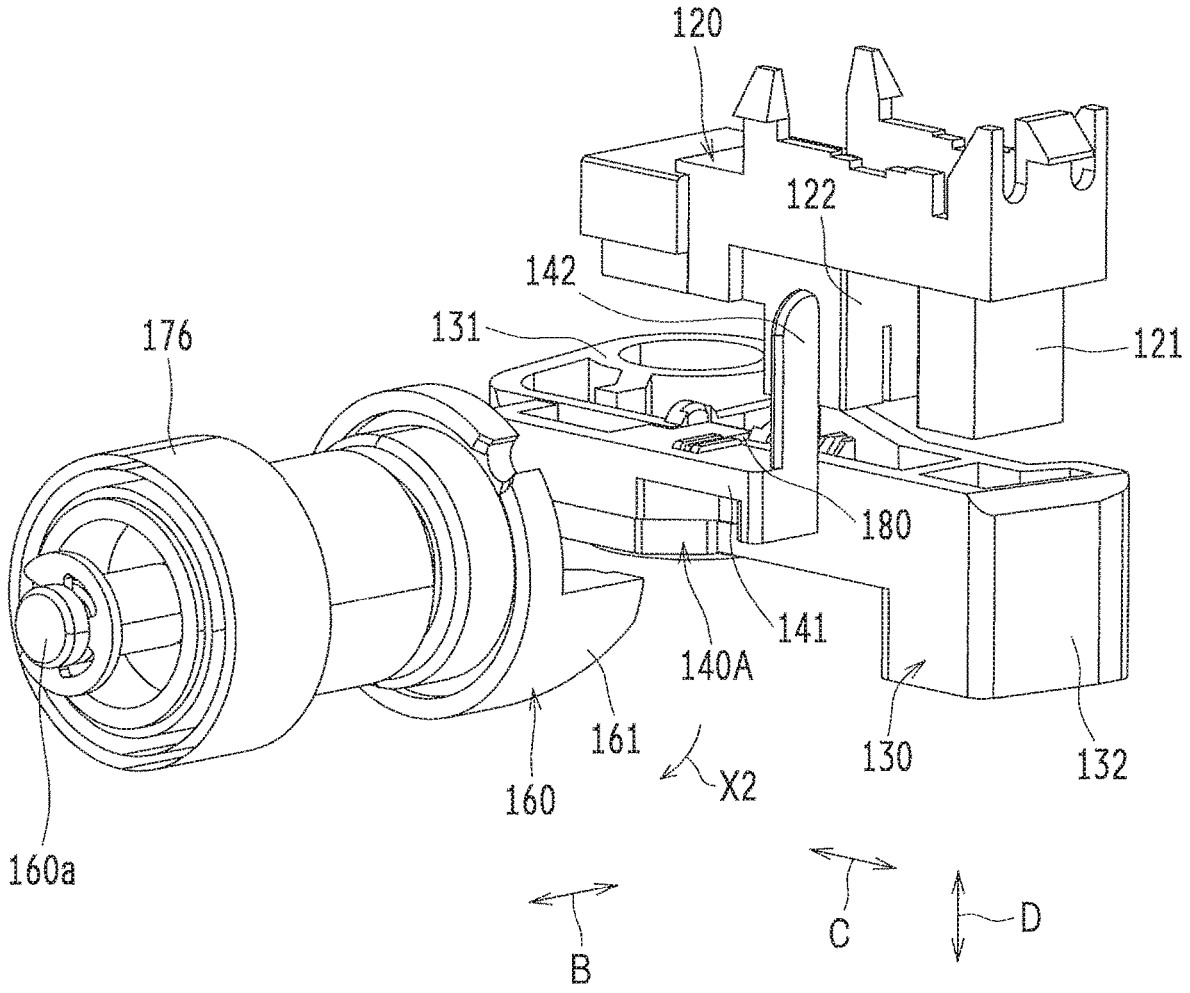
FIG. 13A is a perspective view of the back side surfaces of the detector, the arm member, the movement member, the first biasing member, and the cam member diagonally from the upper left side.
Figure 14A:
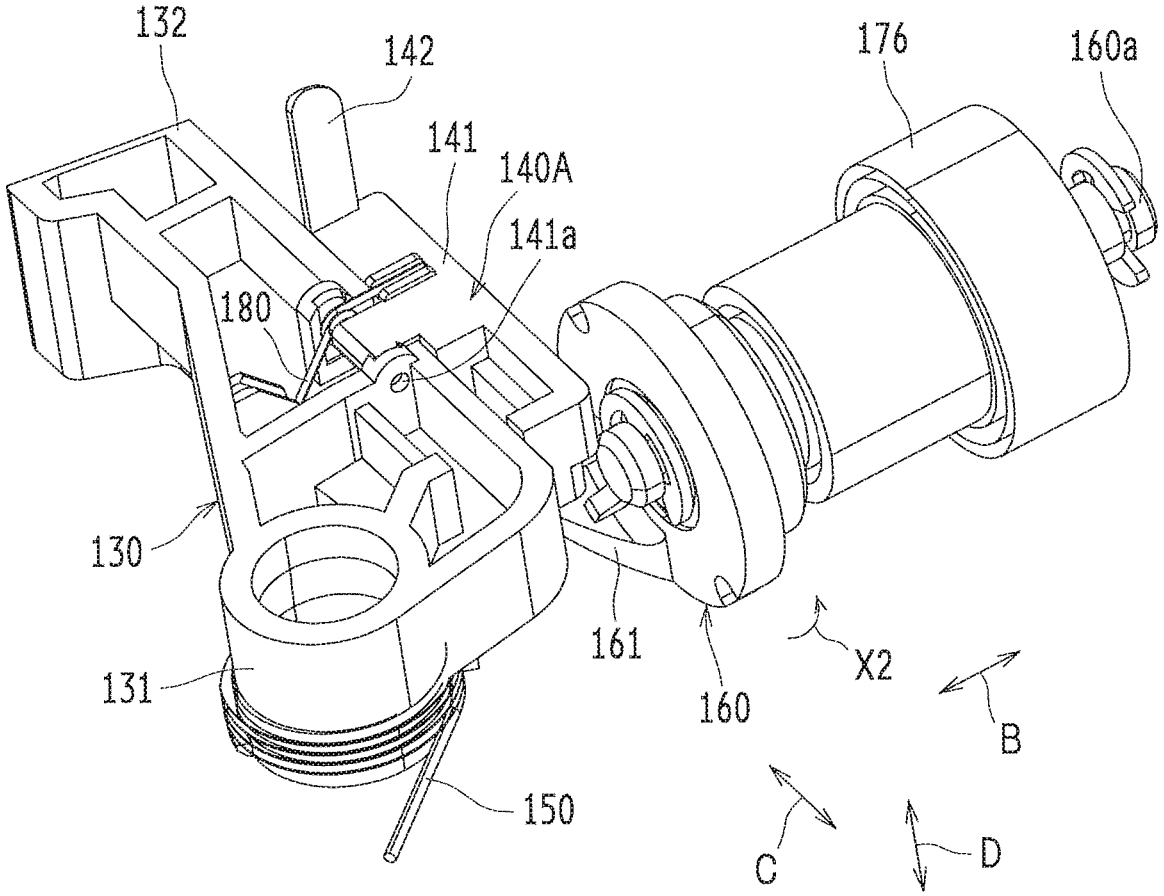
FIG. 14A is a perspective view of the left side surfaces of the arm member, the movement member, the first biasing member, and the cam member diagonally from the upper front side.

Specifically, in the case of performing extrusion detection for the toner cartridge 28, when the cam member 160 is at the initial position, the arm member 130 is at the second non-detection position, and therefore, the detector 120 is OFF as illustrated in FIGS. 13A and 14A.

Figure 13B:
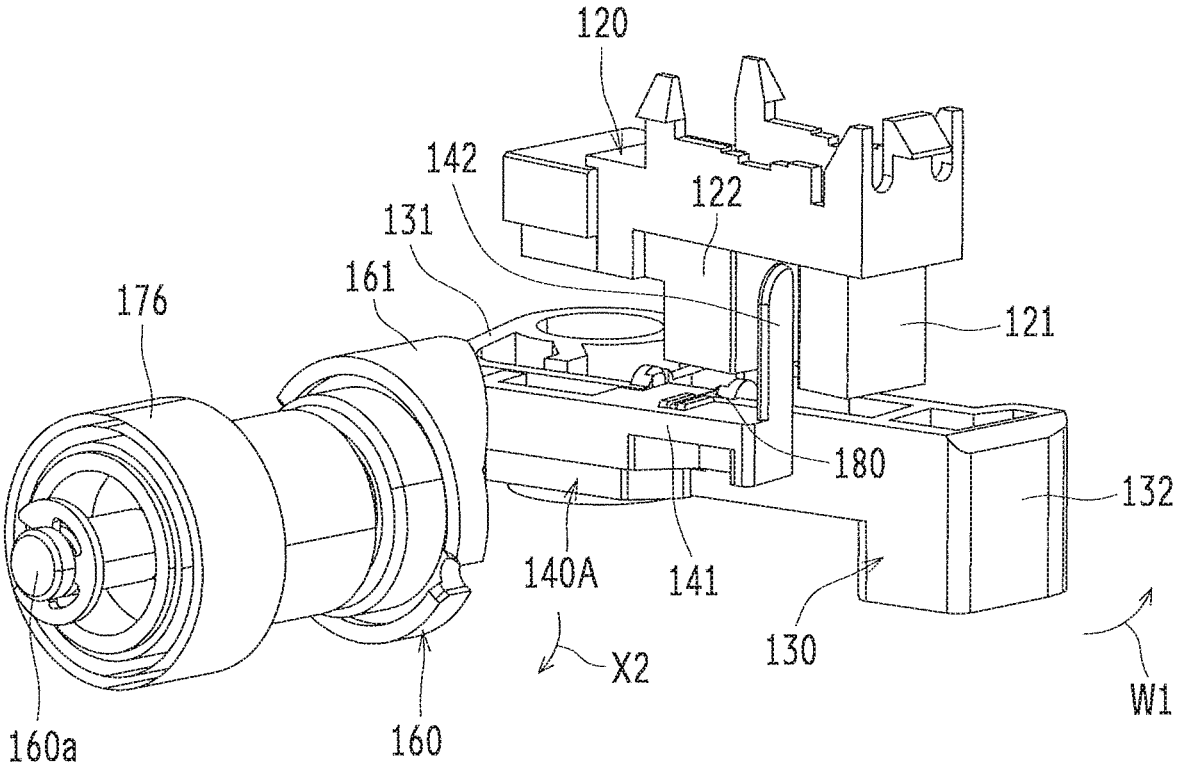
FIG. 13B is a perspective view of the back side surfaces of the detector, the arm member, the movement member, the first biasing member, and the cam member diagonally from the upper left side.
Figure 14B:
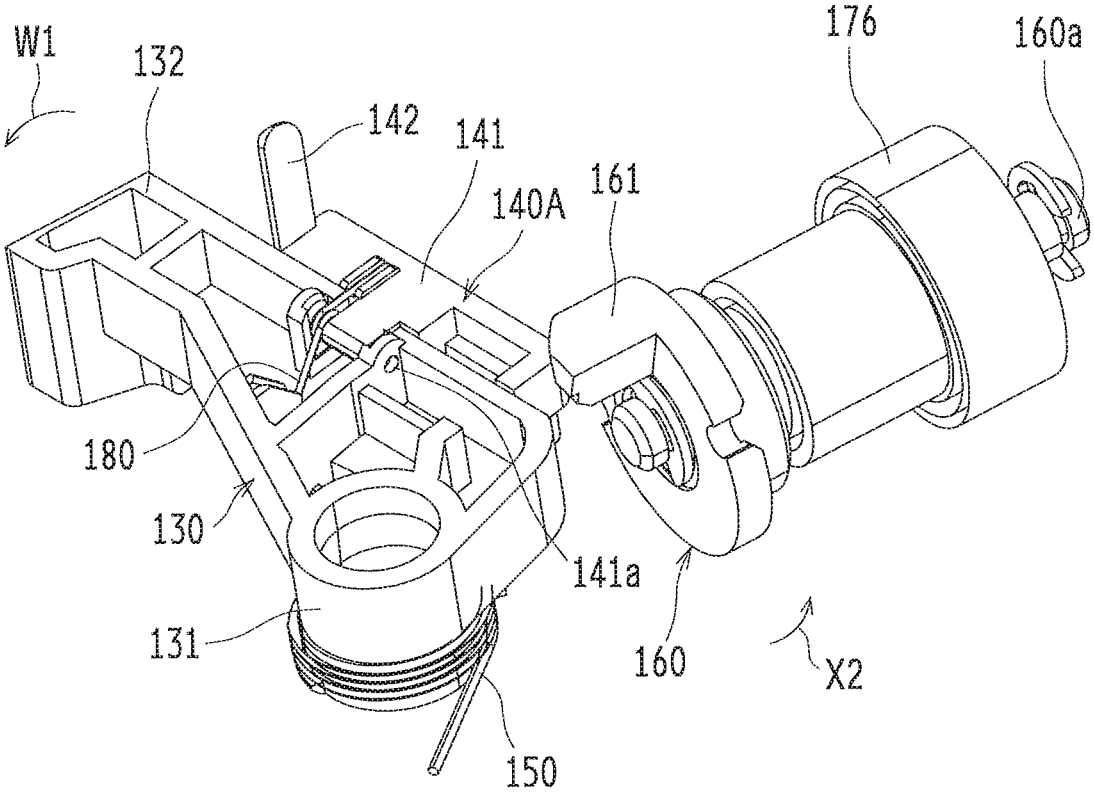
FIG. 14B is a perspective view of the left side surfaces of the arm member, the movement member, the first biasing member, and the cam member diagonally from the upper front side.

When the cam member 160 rotates from the initial position in the second rotation direction X2, the arm member 130 moves (swings in a first swing direction W1), and the detector target 142 moves toward the detector 120 as illustrated in FIGS. 13B and 14B.

Figure 13C:
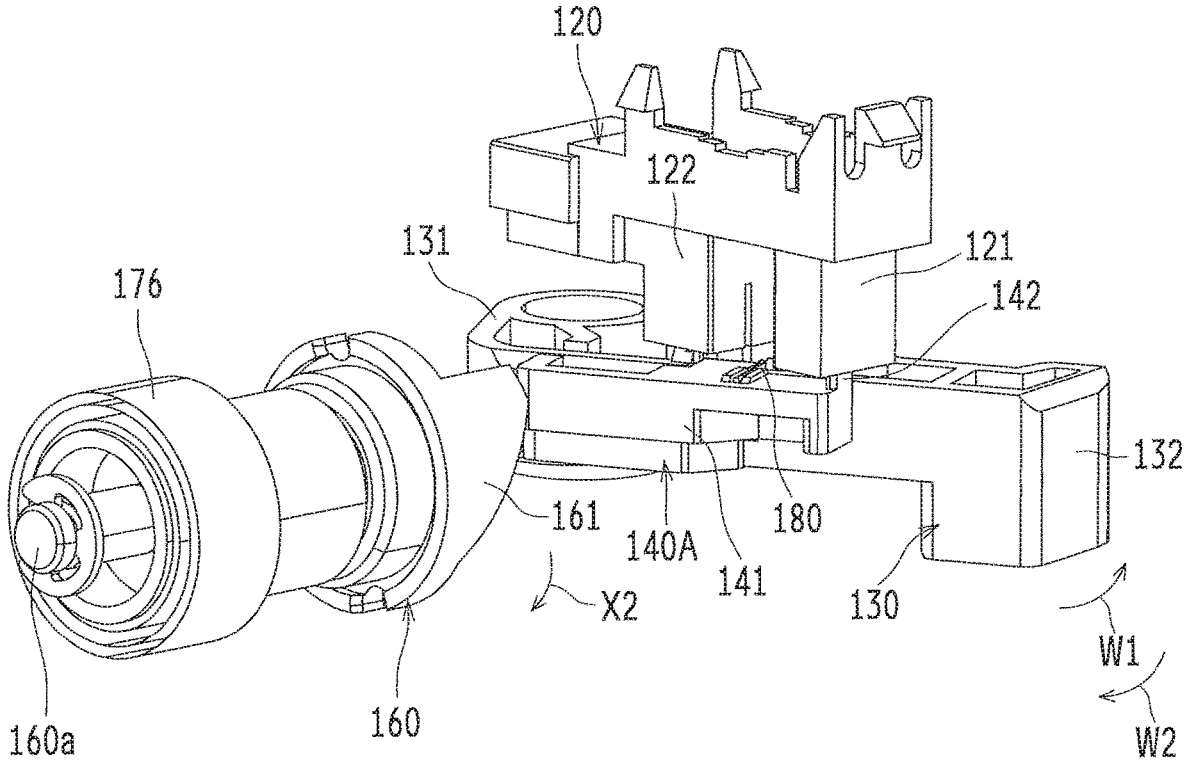
FIG. 13C is a perspective view of the back side surfaces of the detector, the arm member, the movement member, the first biasing member, and the cam member diagonally from the upper left side.
Figure 14C:
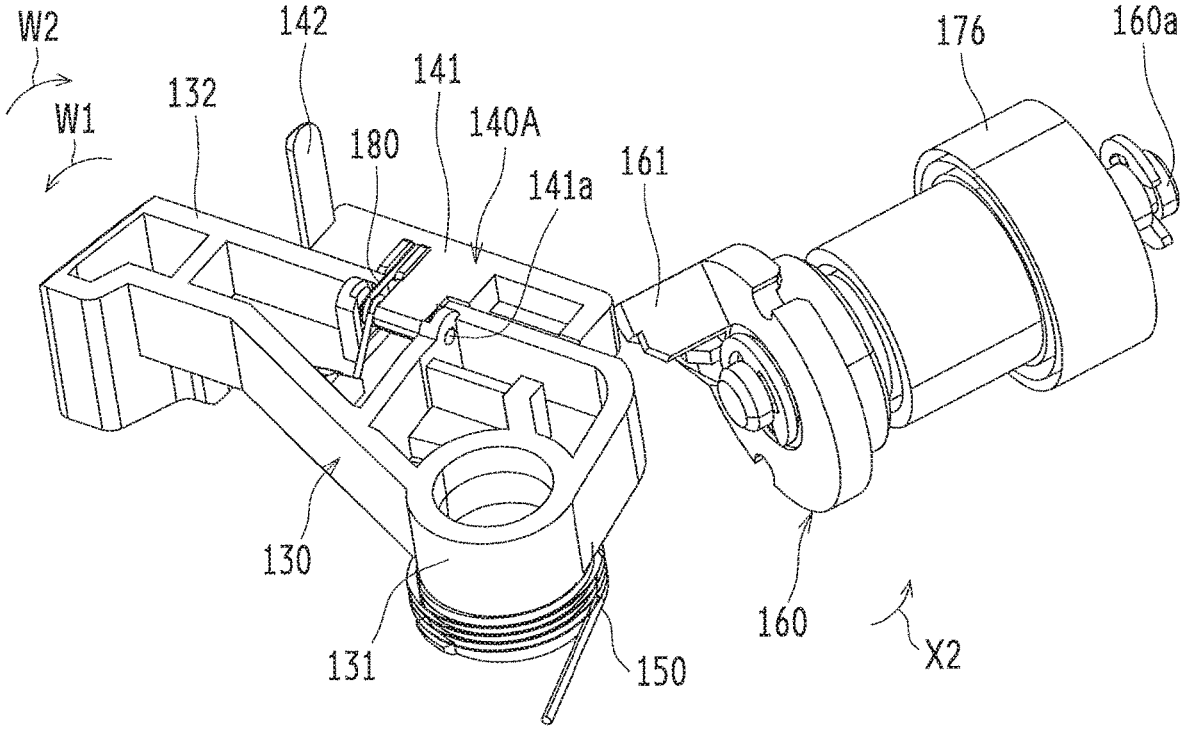
FIG. 14C is a perspective view of the left side surfaces of the arm member, the movement member, the first biasing member, and the cam member diagonally from the upper front side.

When the cam member 160 further rotates in the second rotation direction X2, the arm member 130 further moves (swings in the first swing direction W1), and the detector target 142 is detected by the detector 120. Accordingly, the detector 120 is turned on as illustrated in FIGS. 13C and 14C. When the cam member 160 further rotates in the second rotation direction X2, operation of the arm member 130 by the cam member 160 is canceled. Accordingly, the arm member 130 rotatably moves in a second swing direction W2 opposite to the first swing direction W1 to return to the retraction position as the second non-detection position. Then, when extrusion detection for the toner cartridge 28 ends, the controller 58 rotates the cam member 160 such that the cam member 160 is at the initial position as illustrated in FIGS. 13A and 14A.

As described above, the cam member 160 is rotated with the rotary driving force of the rotary driver (110) in the first rotation direction X1, and therefore, the detector target 142 of the movement member 140A can be displaced between the first non-detection position and the first detection position. Moreover, the cam member 160 is rotated with the rotary driving force of the rotary driver (110) in the second rotation direction X2, and therefore, the detector target 142 of the movement member 140A on the arm member 130 biased by the biasing member (the first biasing member 150) can be moved between the second non-detection position and the second detection position. Thus, drive detection for the rotary driver (110) and extrusion detection for the toner cartridge 28 can be more reliably performed by the single detector 120.

Specifically, the arm member 130 is, at a toner cartridge extrusion device body 101 (see FIGS. 5A and 5B), provided swingably about a swing axis along a height direction D crossing (perpendicular to) a rotation axis direction B. The arm member 130 includes a body portion 131 and an arm portion 132 provided at the body portion 131. The arm member 130 is configured such that the body portion 131 is, at the toner cartridge extrusion device body 101, provided about the swing axis along the height direction D. The arm portion 132 is formed integrally with the body portion 131. The first biasing member 150 (a coil spring) is inserted into the body portion 131 of the arm member 130. One end of the first biasing member 150 is fitted in the toner cartridge extrusion device body 101 and the other end of the first biasing member 150 is fitted in the arm portion 132 such that arm member 130 is biased to the retraction position side.

The movement member 140A is, at the arm member 130, provided rotatably movable about a rotary movement axis along a longitudinal direction C crossing (perpendicular to)

the rotation axis direction B of the cam member 160. In a state in which the arm member 130 is at the retraction position, the movement member 140A comes into contact with the cam member 160 by rotation of the cam member 160 in the first rotation direction X1, thereby rotatably moving in the first rotary movement direction Y1. When the cam member 160 rotates in the first rotation direction X1, contact of the cam member 160 allows rotary movement of the movement member 140A in one direction. On the other hand, in a case where the cam member 160 rotates in the second rotation direction X2, even when the movement member 140A contacts the cam member 160, rotary movement of the movement member 140A in other directions is restricted. Moreover, when the cam member 160 rotates in the first rotation direction X1, the arm member 130 does not swing. On the other hand, when the cam member 160 rotates in the second rotation direction X2, the arm member 130 swings. An inclined portion 161 configured such that the height thereof in the rotation axis direction B increases in the first rotation direction X1 is provided along a circumferential direction at the cam member 160. The inclined portion 161 is a fitting portion to be fit in the movement member 140A. The cam member 160 has a contact region contacting the movement member 140A by rotation and a non-contact region not contacting the movement member 140A.

The detector 120 is fixed to a not-shown support member (e.g., the toner cartridge extrusion device body 101 or the image forming apparatus body 2). The detector 120 is a transmissive photo interrupter, and has a light emitter 121 and a light receiver 122. The detector 120 is electrically connected to an input system of the controller 58 (see FIG. 2). The movement member 140A is a rotary movement member provided swingably about the swing axis along the longitudinal direction C of the arm member 130 at the arm member 130. When the arm member 130 is at the retraction position, the detector target 142 is provided at the movement member 140A to displace between the first detection position and the first non-detection position.

The toner cartridge extrusion device 100A further includes a second biasing member 180 (a coil spring) which biases the movement member 140A to a first non-detection position side of the detector target 142.

The movement member 140A is, at the arm member 130, provided rotatably movable about the rotary movement axis along the longitudinal direction C. The movement member 140A includes a body portion 141 and the detector target 142. The movement member 140A is configured such that the body portion 141 is, at the arm member 130, provided rotatably movable via a support shaft 141*a* along the longitudinal direction C. The second biasing member 180 is inserted into the support shaft 141*a* of the movement member 140A. One end of the second biasing member 180 is fitted in the body portion 141 of the movement member 140A and the other end of the second biasing member 180 is fitted in the arm portion 132 such that the movement member 140A is biased to the first non-detection position side.

By the rotary driving force of the rotary driver (110) in the first rotation direction X1 of the cam member 160, the movement member 140A moves such that the detector target 142 is displaced from the first non-detection position to the first detection position against biasing force of the second biasing member 180. Moreover, contact of the movement member 140A with the cam member 160 is canceled, and therefore, the movement member 140A moves such that the detector target 142 is displaced from the first detection position to the first non-detection position by action of the biasing force of the second biasing member 180.

Note that the second biasing member 180 may bias the movement member 140A to a first detection position side of the detector target 142. In this case, by the rotary driving force of the rotary driver (110) in the first rotation direction X1 of the cam member 160, the movement member 140A moves such that the detector target 142 is displaced from the first detection position to the first non-detection position against the biasing force of the second biasing member 180. Moreover, contact of the movement member 140A with the cam member 160 is canceled, and therefore, the movement member 140A moves such that the detector target 142 is displaced from the first non-detection position to the first detection position by action of the biasing force of the second biasing member 180.

Moreover, by the rotary driving force of the rotary driver (110) in the second rotation direction X2 of the cam member 160, the arm member 130 moves to the extrusion position as the second detection position against the biasing force of the first biasing member 150. Moreover, contact of the arm member 130 with the cam member 160 is canceled, and therefore, the arm member 130 moves to the retraction position as the second non-detection position by action of the biasing force of the first biasing member 150. At this point, the detector target 142 of the movement member 140A is at the first non-detection position in any case.

Second Embodiment

Figure 15A:
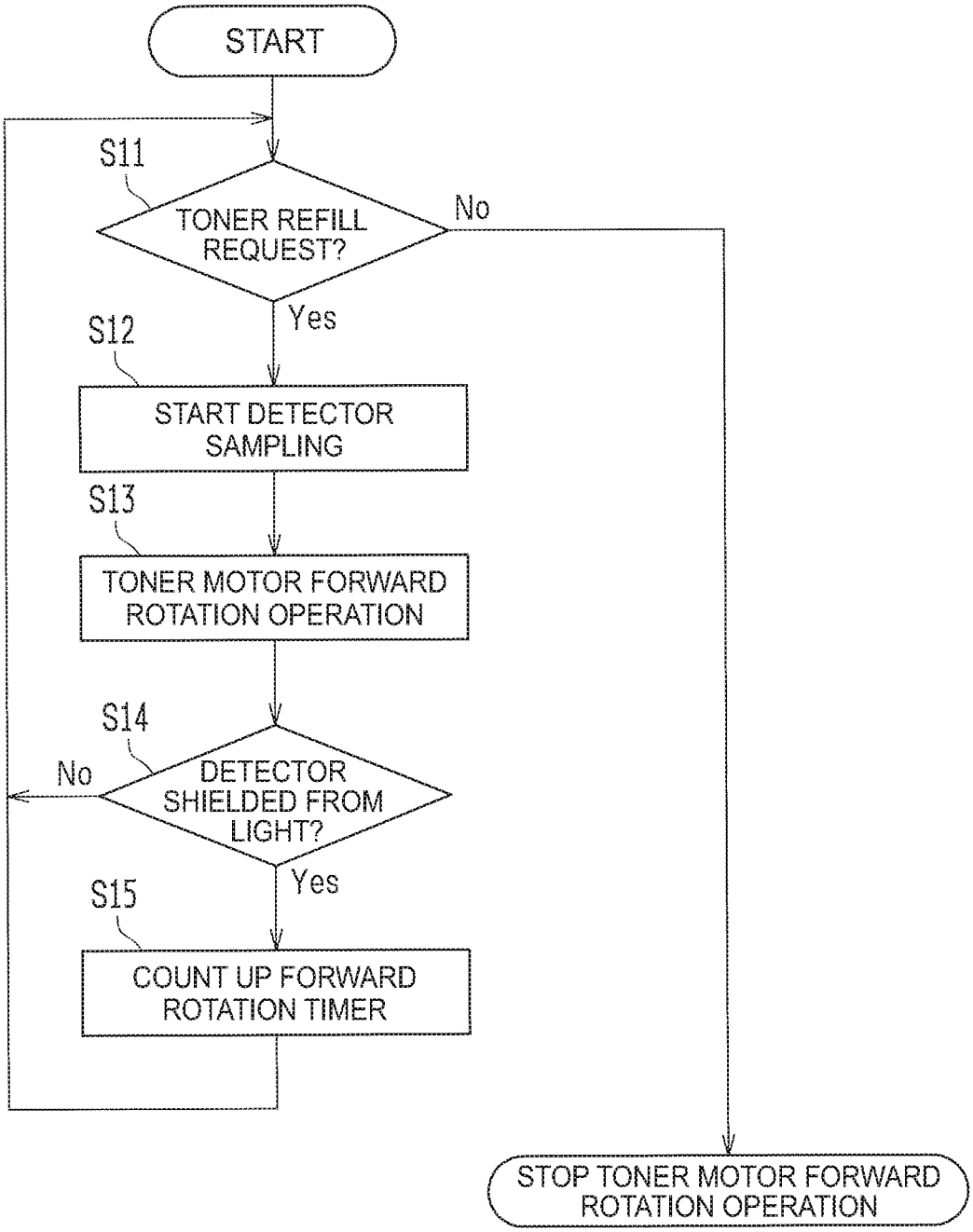
FIG. 15A is a flowchart of the flow of one example of control of the toner cartridge extrusion device according to the first embodiment.
Figure 15B:
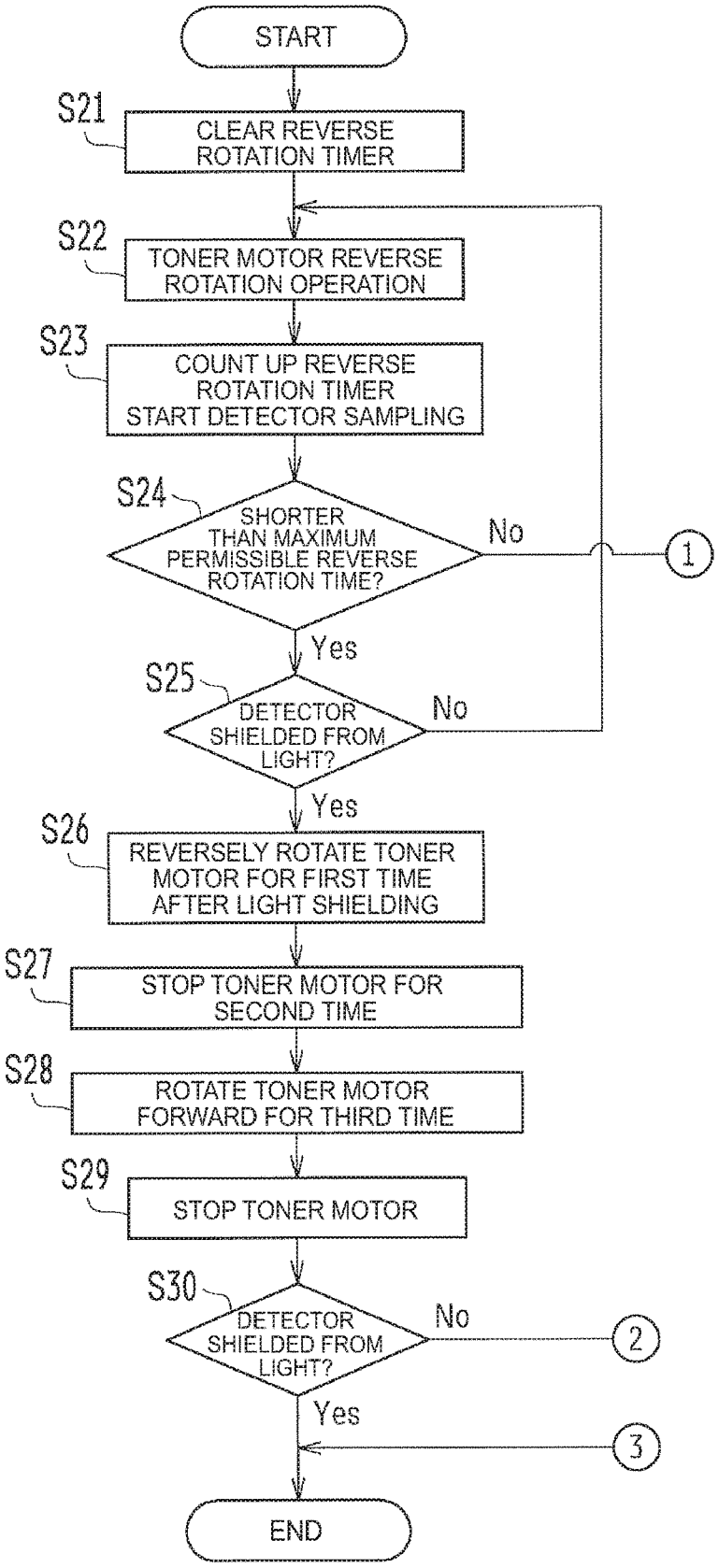
FIG. 15B is a flowchart of the flow of one example of control of the toner cartridge extrusion device according to the first embodiment.
Figure 15C:
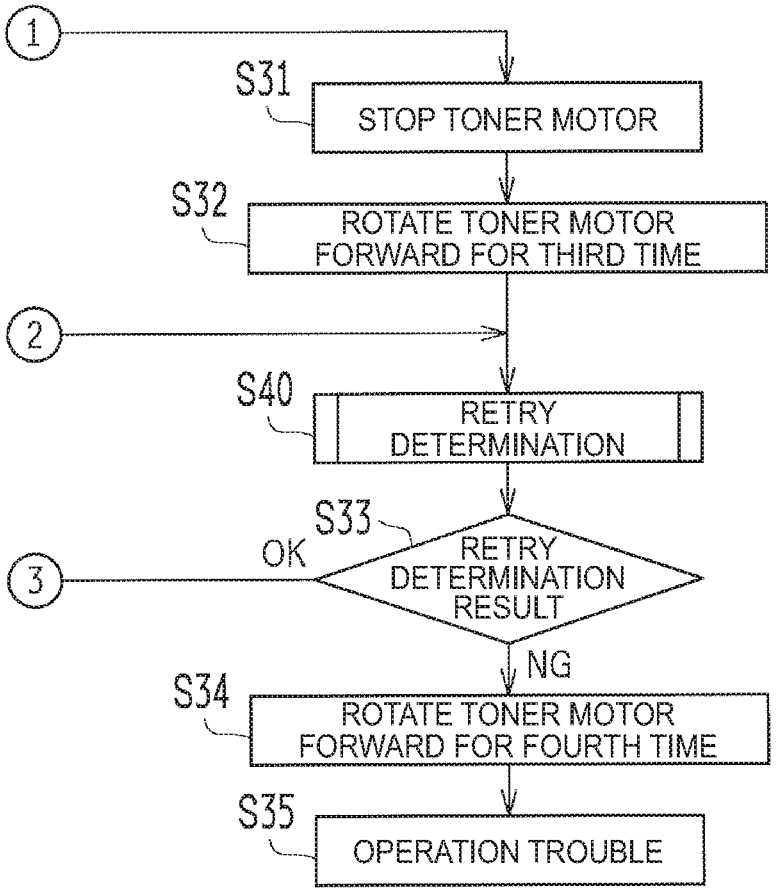
FIG. 15C is a flowchart of the flow of one example of control of the toner cartridge extrusion device according to the first embodiment.
Figure 15D:
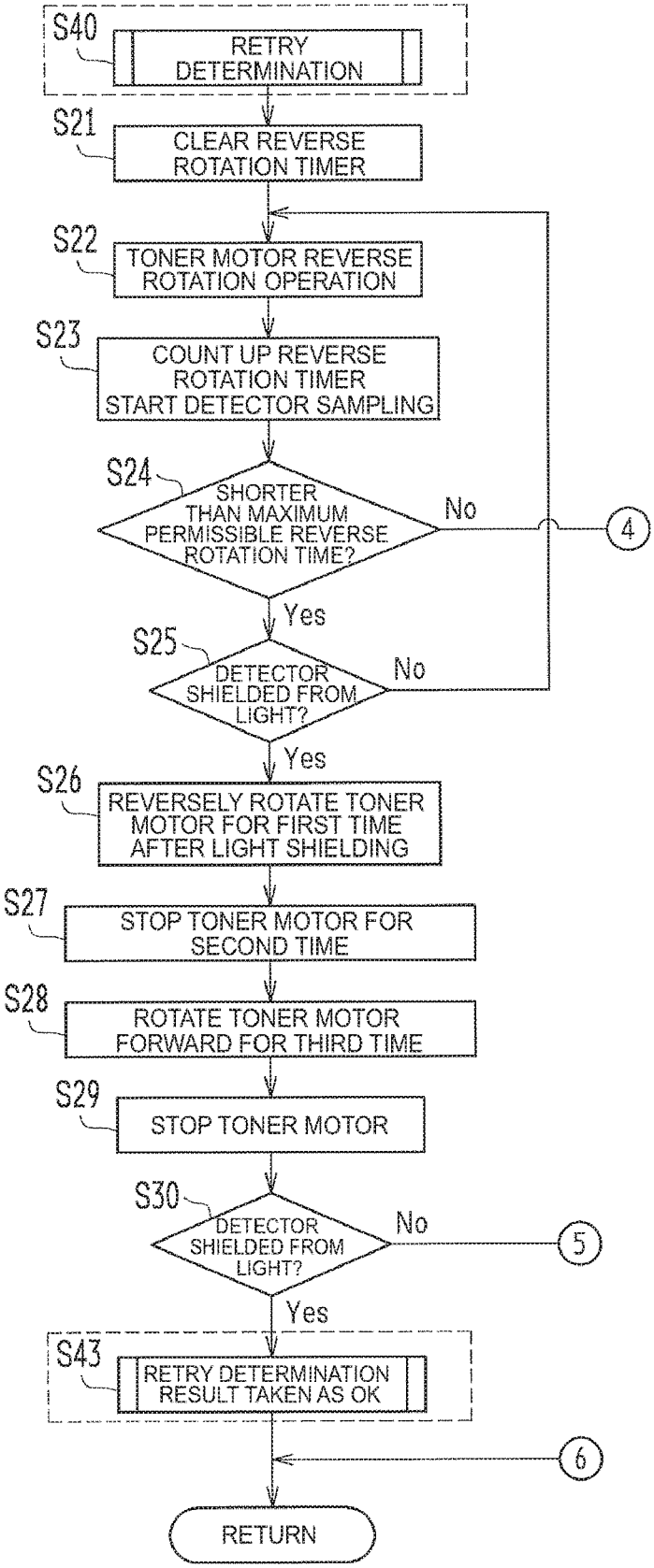
FIG. 15D is a flowchart of the flow of one example of control of the toner cartridge extrusion device according to the first embodiment.
Figure 15E:
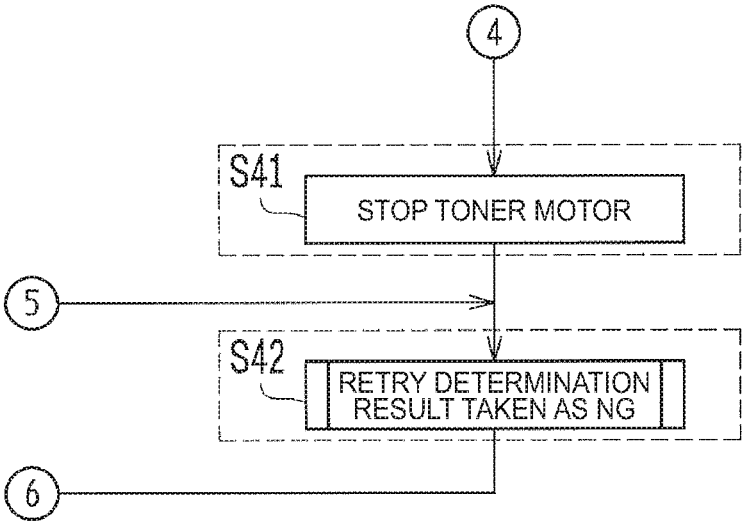
FIG. 15E is a flowchart of the flow of one example of control of the toner cartridge extrusion device according to the first embodiment.

FIGS. 15A to 15E are flowcharts of the flow of one example of control of a toner cartridge extrusion device 100A according to the first embodiment. FIG. 15A illustrates a control example where toner refill amount detecting operation is performed as drive detection operation for a driver 110. FIGS. 15B and 15C illustrate a control example of a main routine for performing extrusion detection operation for a toner cartridge 28. FIGS. 15D and 15E illustrate a control example of a sub-routine for performing the extrusion detection operation for the toner cartridge 28.

Drive Detection Operation for Driver

In the control example of the drive detection operation (the toner refill amount detecting operation) for the driver (110) as illustrated in FIG. 15A, a controller 58 first determines whether or not there is a toner refill request (S11). In a case where there is the toner refill request (S11: Yes), sampling of a detector 120 is started (S12), and forward rotation operation of the toner motor (110) in a first rotation direction X1 is performed (S13). Next, the controller 58 determines whether or not the detector 120 is shielded from light by a detector target 142 (S14). In a case where the detector 120 is not shielded from light by the detector target 142 (S14: No), the processing transitions to S11. On the other hand, in a case where the detector 120 is shielded from light by the detector target 142 (S14: Yes), the controller 58 counts up a forward rotation timer (S15), and the processing transitions to S11. In a case where there is no toner refill request (S11: No), the controller 58 stops the forward rotation operation of the toner motor (110) in the first rotation direction X1.

Extrusion Detection Operation for Toner Cartridge

In the control example of the extrusion detection operation for the toner cartridge 28 as illustrated in FIGS. 15B to 15E, in the control example illustrated in FIG. 15B, the controller 58 first clears a reverse rotation tinier (S21), and performs reverse rotation operation of the toner motor (110) in a second rotation direction X2 (S22). Next, the controller 58 counts up a reverse rotation timer, and starts sampling of the detector 120 (S23). The controller 58 determines whether or not the reverse rotation timer is shorter than maximum permissible reverse rotation time (e.g., 5.0 seconds) (S24). The maximum permissible reverse rotation time described herein is maximum permissible timer required until the detector target 142 of a movement member 140A reaches a second detection position by reverse rotation of the toner motor (110).

In a case where the reverse rotation timer is shorter than the maximum permissible reverse rotation time (S24: Yes), the controller 58 determines whether or not the detector 120 is shielded from light by the detector target 142 (S25). In a case where the detector 120 is not shielded from light by the detector target 142 (S25: No), the processing transitions to S22. On the other hand, in a case where the detector 120 is shielded from light by the detector target 142 (S25: Yes), the controller 58 reversely rotates the toner motor (110) in the second rotation direction X2 for predetermined first time (e.g., 1.0 second) after light shielding (S26), and thereafter, stops the toner motor (110) for predetermined second time (e.g., 0.1 second) (S27). Then, the controller 58 rotates the toner motor (110) forward in the first rotation direction X1 for predetermined third time (e.g., 1.2 seconds) (S28), and thereafter, stops the toner motor (110). Then, the controller 58 determines whether or not the detector 120 is shielded from light by the detector target 142 (S30).

In a case where the detector 120 is shielded from light by the detector target 142 (S30: Yes), the controller 58 ends the extrusion detection operation for the toner cartridge 28. On the other hand, in a case where the detector 120 is not shielded from light by the detector target 142 (S30: No), the processing transitions to a sub-routine of retry determination of S40 illustrated in FIG. 15C.

On the other hand, in a case where the reverse rotation timer is equal to or longer than the maximum permissible reverse rotation time (S24: No), the processing transitions to S31 illustrated in FIG. 15C, and the controller 58 stops the toner motor (110) (S31). The controller 58 rotates the toner motor (110) forward in the first rotation direction X1 for the predetermined third time (e.g., 1.2 seconds) (S32), and thereafter, the processing transitions to the sub-routine of retry determination of S40.

When the sub-routine of retry determination of S40 ends, the controller 58 determines whether a retry determination result is OK or NG (S33). In a case where the retry determination result is OK (S33: OK), the processing transitions to the flowchart illustrated in FIG. 15B, and the extrusion detection operation for the toner cartridge 28 ends. On the other hand, in a case where the retry determination result is NG (S33: NG), the controller 58 rotates the toner motor (110) forward in the first rotation direction X1 for predetermined fourth time (e.g., 3.5 seconds) (S34), and informs an indication of an operation trouble (S35).

The control example of the sub-routine of retry determination as illustrated in FIGS. 15D and 15E is similar to the control example illustrated in FIGS. 15B and 15C, except that S41 to S43 are provided instead of S31 to S35 of the control example illustrated in FIGS. 15B and 15C (see portions indicated by dashed lines). Differences from S31 to S35 of the control example illustrated in FIGS. 15B and 15C will be mainly described.

In a case where the reverse rotation timer is equal to or longer than the maximum permissible reverse rotation time (S24: No), the processing transitions to S41 illustrated in FIG. 15E, and the controller 58 stops the toner motor (110) (S41). The controller 58 takes the retry determination result as NG (S42), and the processing returns to the main routine illustrated in FIG. 15C. In a case where the detector 120 is not shielded from light by the detector target 142 (S30: No), the processing transitions to S42 illustrated in FIG. 15E, and the controller 58 takes the retry determination result as NO (S42). The processing returns to the main routine illustrated in FIG. 15C. On the other hand, in a case where the detector 120 is shielded from light by the detector target 142 (S30: Yes), the controller 58 takes the retry determination result as OK (S43), and the processing returns to the main routine illustrated in FIG. 15C.

Third Embodiment

Figure 16A:
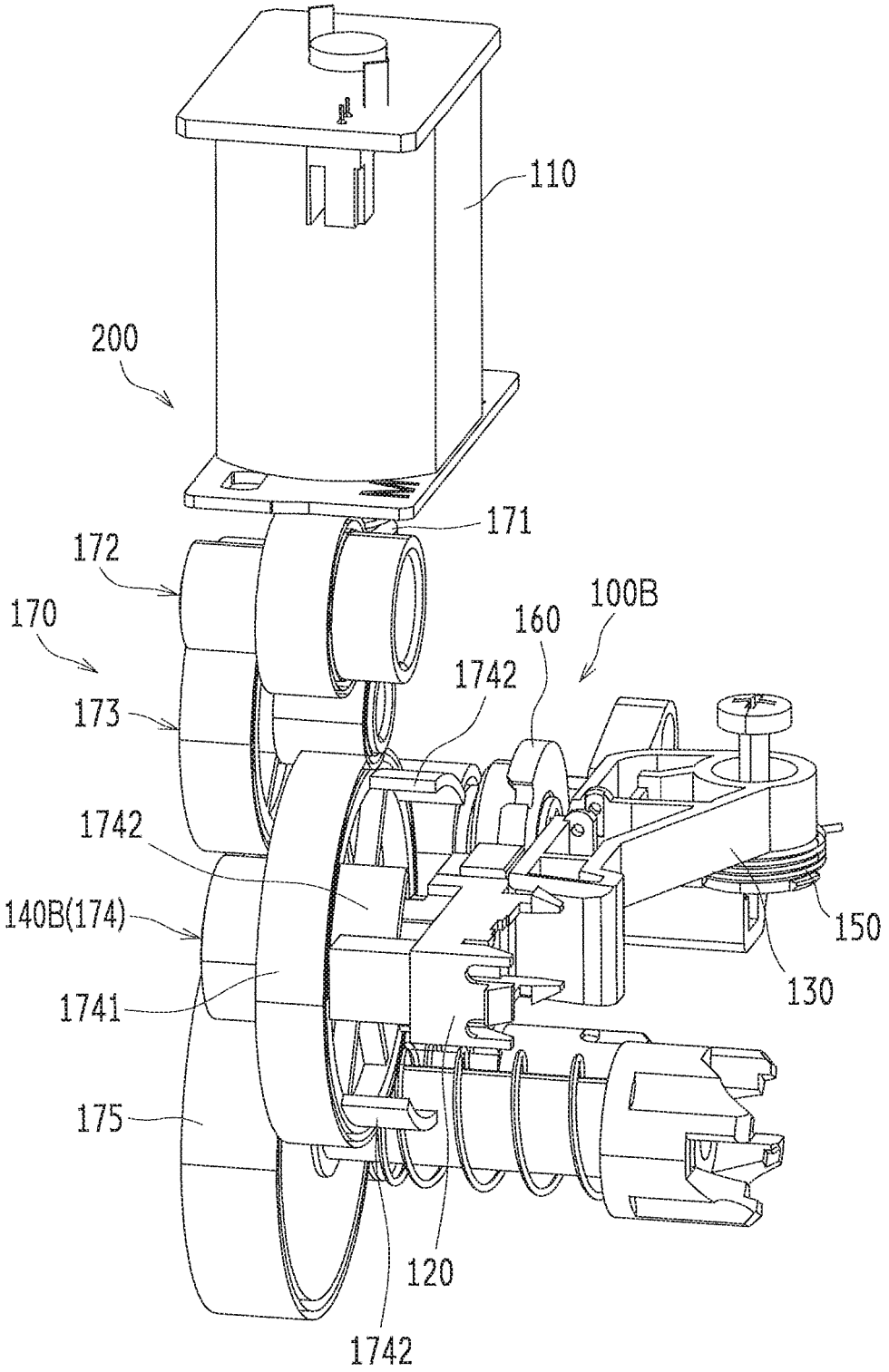
FIG. 16A is a perspective view of a left side surface of a drive device including a toner cartridge extrusion device according to a third embodiment diagonally from an upper front side.
Figure 16B:
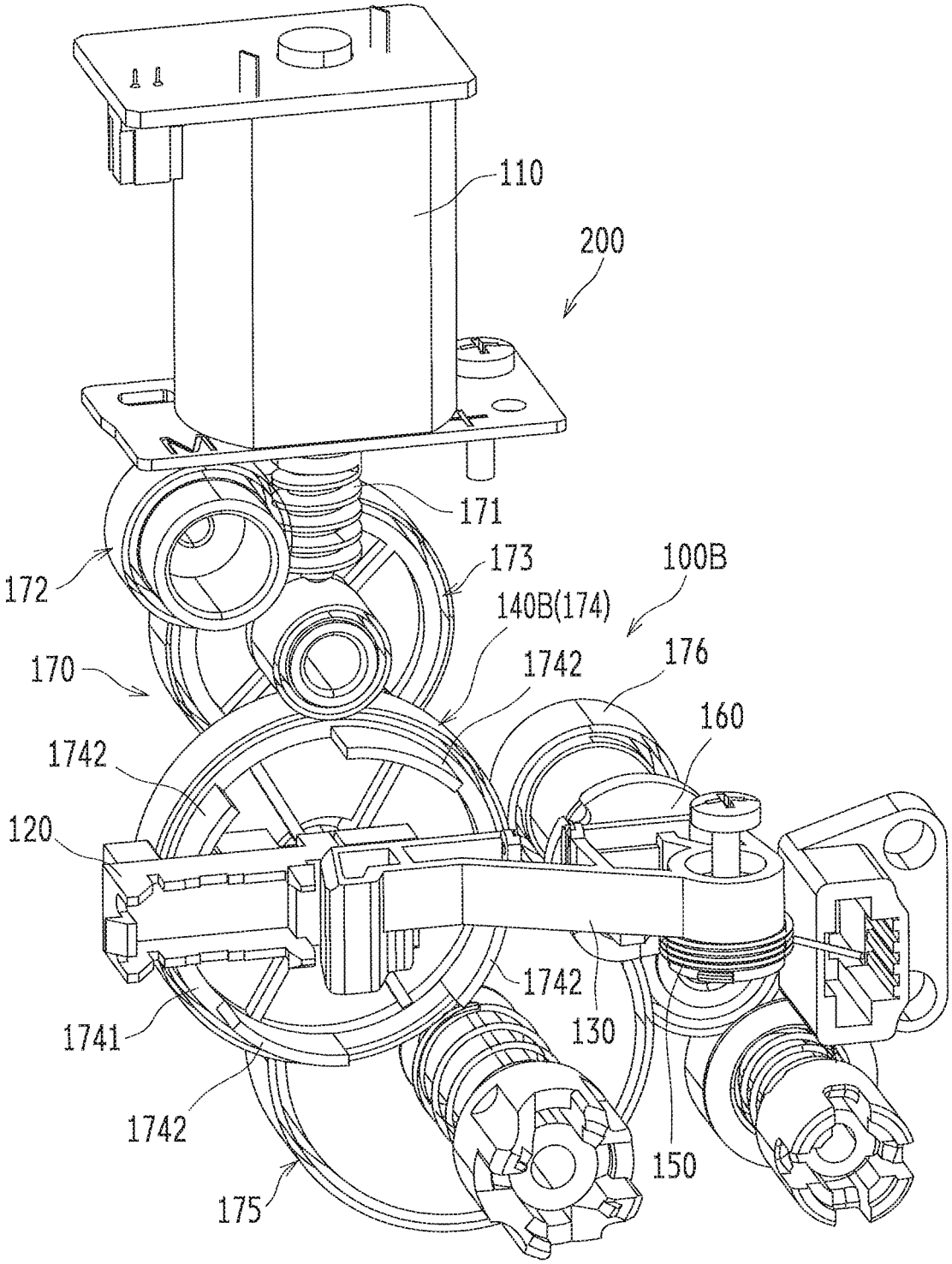
FIG. 16B is a perspective view of a front side surface of the drive device including the toner cartridge extrusion device according to the third embodiment diagonally from an upper left side.

FIG. 16A is a perspective view of a left side surface of a drive device 200 including a toner cartridge extrusion device 100B according to a third embodiment diagonally from an upper front side FIG. 16B is a perspective view of a front side surface of the drive device 200 including the toner cartridge extrusion device 100B according to the third embodiment diagonally from an upper left side.

Figure 17A:
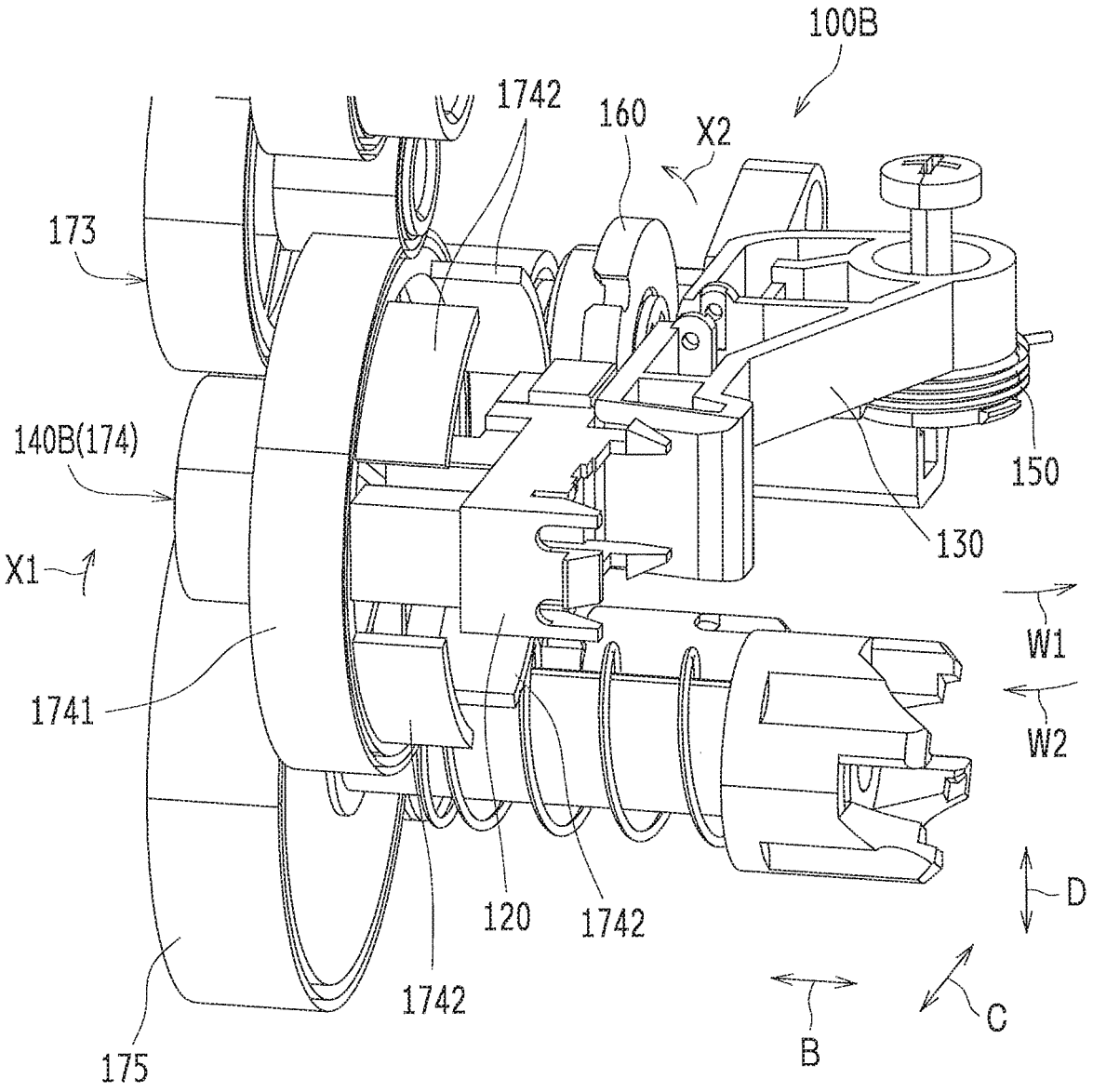
FIG. 17A is a perspective view of a toner cartridge extrusion device portion illustrated in FIG. 16A.
Figure 17B:
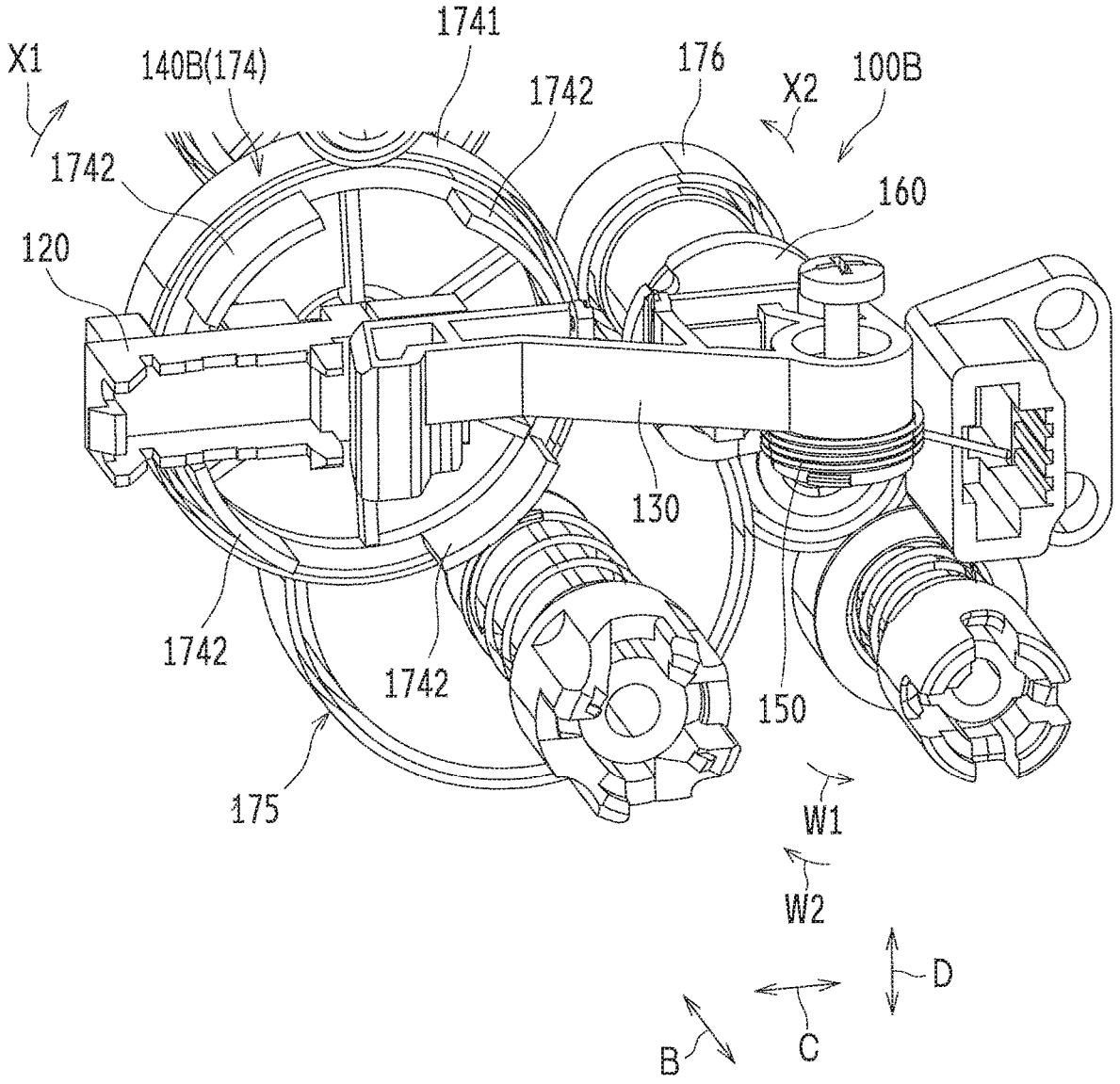
FIG. 17B is a perspective view of a toner cartridge extrusion device portion illustrated in FIG. 16B.
Figure 18A:
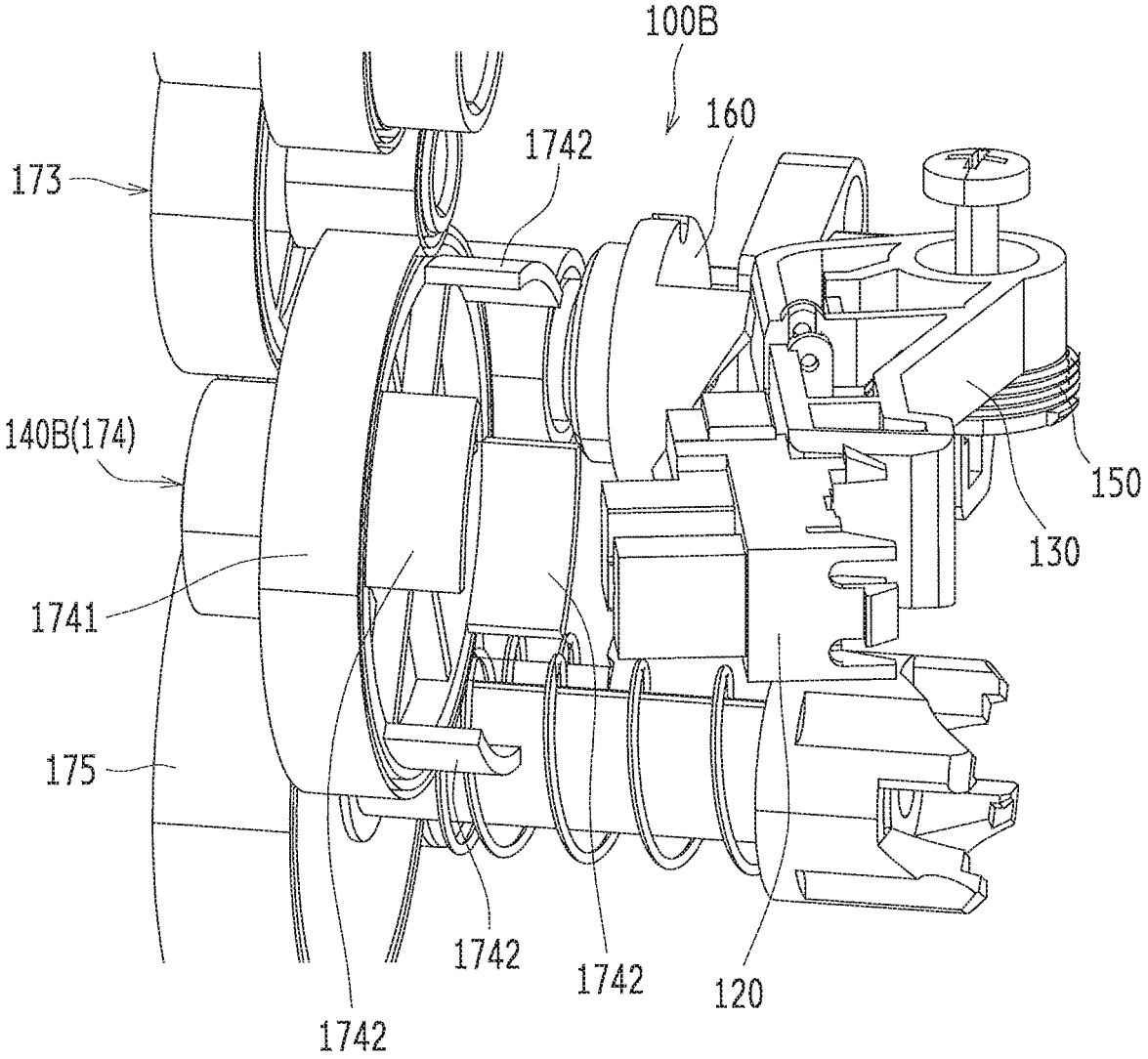
FIG. 18A is a perspective view of the toner cartridge extrusion device portion illustrated in FIG. 16A.
Figure 18B:
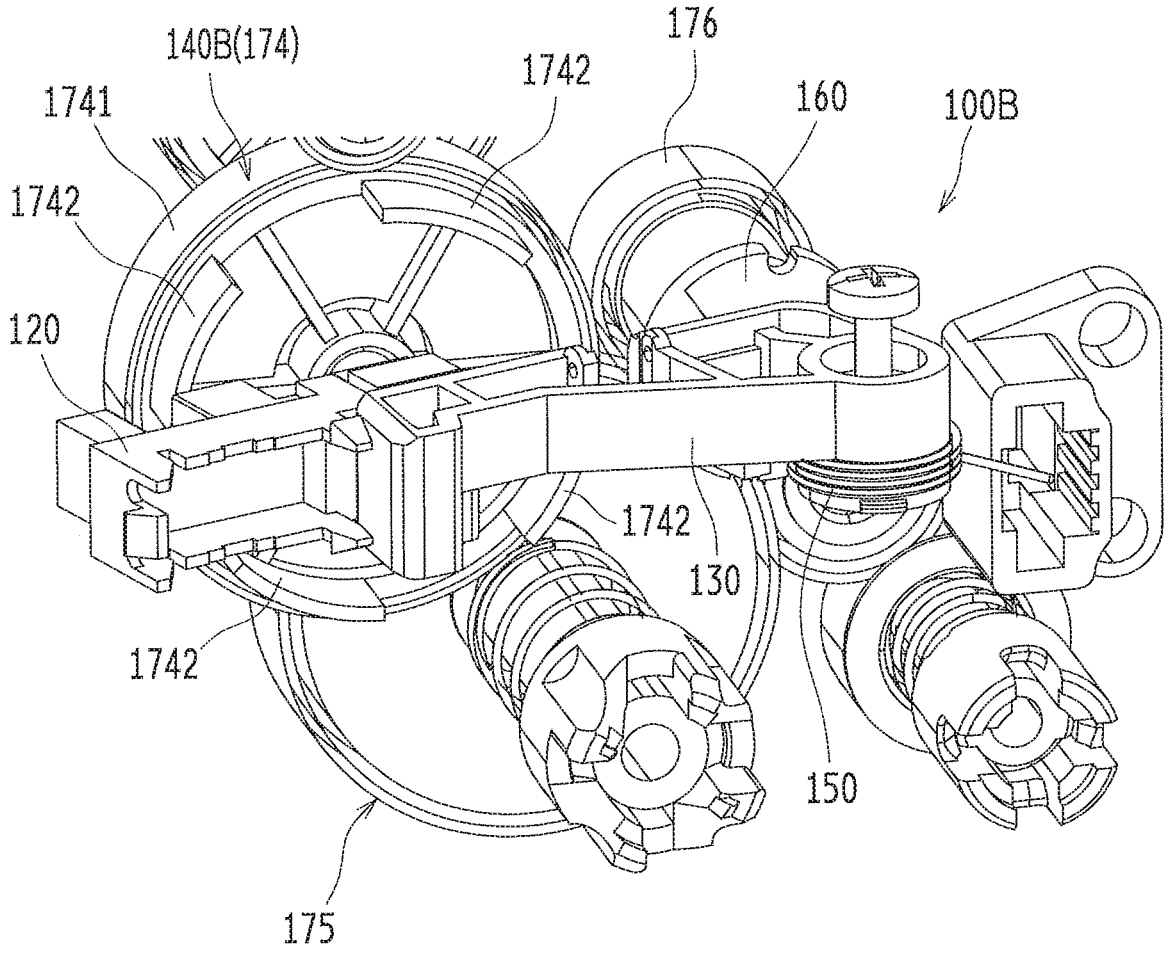
FIG. 18B is a perspective view of the toner cartridge extrusion device portion illustrated in FIG. 16B.

FIGS. 17A and 18A are perspective views of a portion as the toner cartridge extrusion device 100B illustrated in FIG. 16A. FIGS. 17B and 18B are perspective views of a portion as the toner cartridge extrusion device 100B illustrated in FIG. 16B.

The toner cartridge extrusion device 100B according to the third embodiment is configured such that a movement member 140B is provided at a toner cartridge extrusion device body 101 instead of the movement member 140A provided at the arm member 130 in the toner cartridge extrusion device 100A according to the first embodiment and an attachment position of a single detector 120 is changed. On other points, the toner cartridge extrusion device 100B is similar to the toner cartridge extrusion device 100A, and description thereof will be omitted.

The toner cartridge extrusion device 100B includes an arm member 130 and the movement member 140B (a fourth gear 174). A detector target 1742 to be detected by the single detector 120 is provided at the movement member 140B (the fourth gear 174). The single detector 120 is provided at the arm member 130. The single detector 120 performs drive detection by movement operation (rotation operation) of the movement member (the fourth gear 174), and performs extrusion detection by extrusion operation of the arm member 130.

With this configuration, the single detector 120 can perform drive detection for a driver 110 (a rotary driver) in the movement operation (the rotation operation) of the movement member 140B (the fourth gear 174). Moreover, the single detector 120 can perform extrusion detection for a toner cartridge 28 in the extrusion operation of the arm member 130. Thus, drive detection for the driver 110 and extrusion detection for the toner cartridge 28 performed by the single detector 120 can be implemented with a simple configuration.

In the third embodiment, the movement member 140B (the fourth gear 174) is movable (rotatable) such that the detector target 1742 is displaced between a first detection position (a position in FIGS. 16A and 16B) at which the detector target 1742 is detected by the single detector 120 and a first non-detection position (a position in FIGS. 17A and 17B) at which the detector target 1742 is not detected by the single detector 120. Thus, the single detector 120 can perform drive detection for the driver 110 (the rotary driver)

by detecting the presence or absence of the detector target 1742 displaced between the first detection position and the first non-detection position.

Moreover, a retraction position (a position in FIGS. 16A, 16B, 17A, and 17B) of the arm member 130 is a second detection position at which the single detector 120 detects the detector target 1742. Further, an extrusion position (a position in FIGS. 18A and 18B) of the arm member 130 is a second non-detection position at which the single detector 120 does not detect the detector target 1742. Note that the retraction position of the arm member 130 may be the second non-detection position, and the extrusion position of the arm member 130 may be the second detection position.

With this configuration, the single detector 120 can perform extrusion detection for the toner cartridge 28 by detecting the presence or absence of the detector target 1742 moved between the second detection position and the second non-detection position. Upon extrusion detection for the toner cartridge 28, the detector target 1742 of the movement member 140B is at a predetermined position (e.g., the first detection position or the first non-detection position, and the first detection position in this example).

With this configuration, drive detection for the driver 110 (the rotary driver) and extrusion detection for the toner cartridge 28 can be reliably performed by the single detector 120.

Specifically, the movement member 140B (the fourth gear 174) is a rotary member which rotates by rotary driving force of the rotary driver (110) in a first rotation direction X1 such that the detector target 1742 is alternately displaced between the first detection position and the first non-detection position. The movement member 140B (the fourth gear 174) is, at the toner cartridge extrusion device body (specifically, a drive transmitter 170), provided rotatably about a rotary movement axis along a rotation axis direction B. The movement member 140B (the fourth gear 174) includes a body portion 1741 and the detector target 1742. The detector target 1742 includes one or more detector targets 1742 (multiple detector targets 1742 in this example) provided along a circumferential direction at an outer peripheral edge portion of the body portion 1741. The detector targets 1742 are provided to protrude from the body portion 1741 to a detector 120 side.

With this configuration, the rotary member [140B (176)] can be rotated by the rotary driving force of the rotary driver (110) in the first rotation direction X1. Thus, the detector targets 1742 of the rotary member [140B (176)] can be displaced between the first non-detection position and the first detection position. Moreover, a cam member 160 can be rotated by rotary driving force of the rotary driver (110) in a second rotation direction X2. Thus, the single detector 120 on the arm member 130 biased by a first biasing member 150 can be moved between the second non-detection position and the second detection position. Consequently, drive detection for the driver 110 and extrusion detection for the toner cartridge 28 can be more reliably performed by the single detector 120.

Specifically, by the rotary driving force of the rotary driver (110) in the first rotation direction X1, the movement member 140B (the fourth gear 174) moves such that the detector targets 1742 are displaced between the first non-detection position and the first detection position.

Moreover, by the rotary driving force of the rotary driver (110) in the second rotation direction X2 of the cam member 160, the arm member 130 is moved to the extrusion position as the second non-detection position against biasing force of the first biasing member 150. Further, contact of the arm member 130 with the cam member 160 is canceled, and therefore, the arm member 130 moves to the retraction position as the second detection position by action of the biasing force of the first biasing member 150. At this point, the detector targets 1742 of the movement member 140B (the fourth gear 174) are at the first detection position in any case.

Fourth Embodiment

Figure 19A:
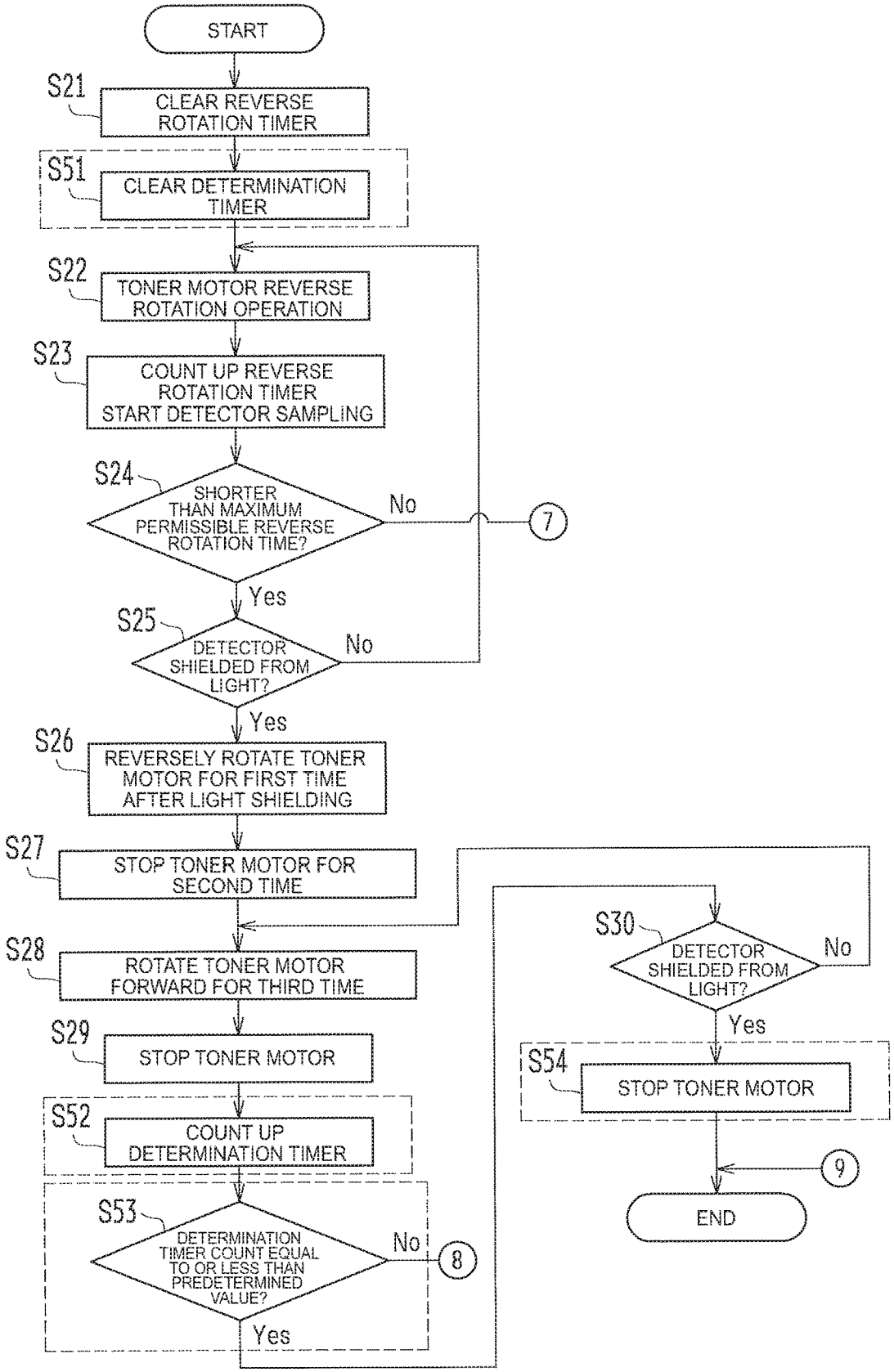
FIG. 19A is a flowchart of the flow of one example of control of the toner cartridge extrusion device according to the third embodiment.
Figure 19B:
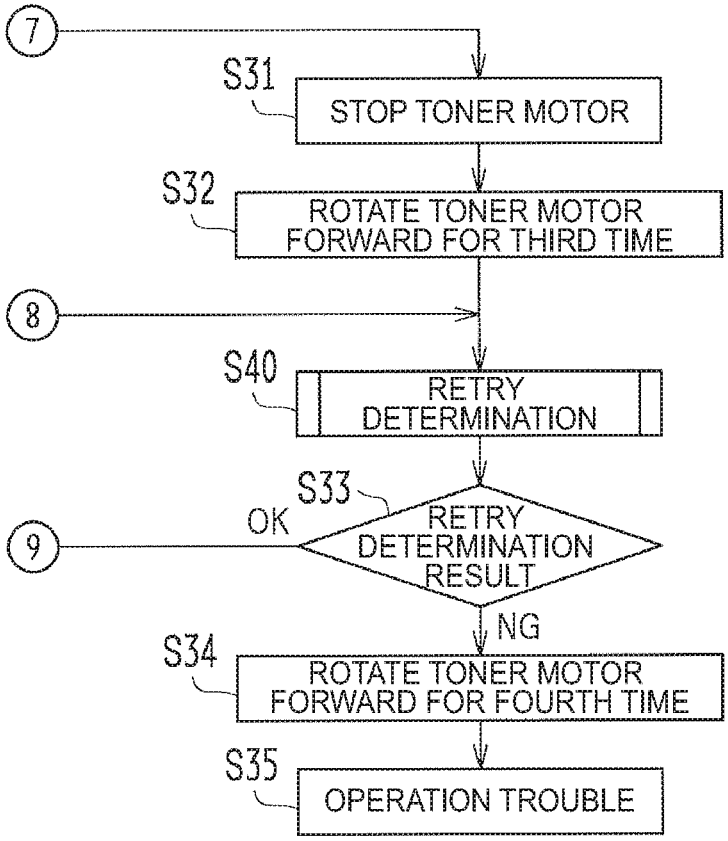
FIG. 19B is a flowchart of the flow of one example of control of the toner cartridge extrusion device according to the third embodiment.
Figure 19C:
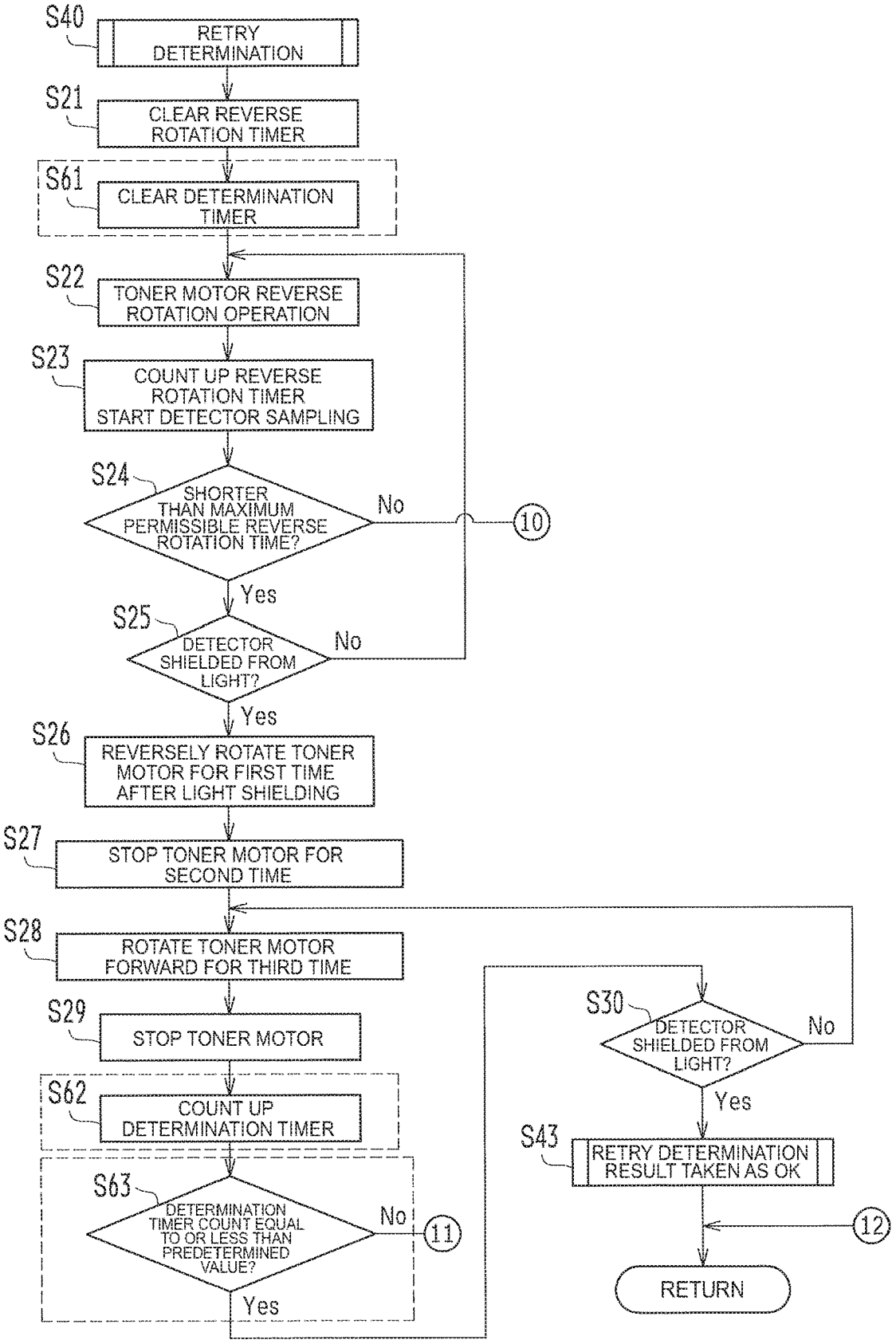
FIG. 19C is a flowchart of the flow of one example of control of the toner cartridge extrusion device according to the third embodiment.
Figure 19D:
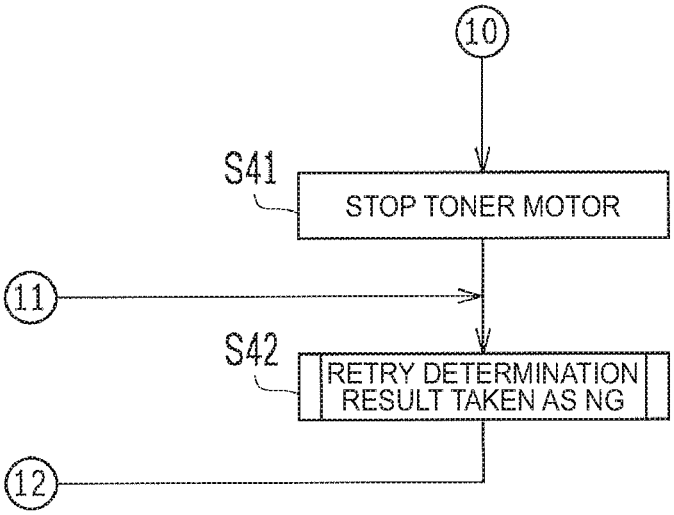
FIG. 19D is a flowchart of the flow of one example of control of the toner cartridge extrusion device according to the third embodiment.

FIGS. 19A to 19D are flowcharts of the flow of one example of control of a toner cartridge extrusion device 100B according to the third embodiment. FIGS. 19A and 19B illustrate a control example of a main routine for performing extrusion detection operation for a toner cartridge 28. FIGS. 19C and 19D illustrate a control example of a sub-routine for performing the extrusion detection operation for the toner cartridge 28.

Drive Detection Operation for Driver

Drive detection operation (toner refill amount detecting operation) for a driver (110) of the fourth embodiment is similar to the drive detection operation (the toner refill amount detecting operation) for the driver (110) of the first embodiment as illustrated in FIG. 15A, and description thereof will be omitted herein.

Extrusion Detection Operation for Toner Cartridge

The control example illustrated in FIGS. 19A and 19B is similar to the control example illustrated in FIGS. 15B and 15C, except that S51 is provided between S21 and S22 of the control example illustrated in FIGS. 15B and 15C, S52 and S53 are provided between S29 and S30, and S54 is provided after determination as Yes at S30 (see portions indicated by dashed lines). Differences from S31 to S35 of the control example illustrated in FIGS. 15B and 15C will be mainly described.

After S21, a controller 58 clears a determination timer (S51), and the processing transitions to S22. Moreover, after S29, the controller 58 counts up the determination timer (S52), and determines whether or not the count of the determination timer is equal to or less than a predetermined value (e.g., five) (S53). In a case where the count of the determination timer is equal to or less than the predetermined value (S53: Yes), the controller 58 transitions to S30. On the other hand, in a case where the count of the determination timer exceeds the predetermined value (S53: No), the controller 58 transitions to a sub-routine of retry determination of S60 illustrated in FIG. 19B.

A control example of the sub-routine of retry determination illustrated in FIGS. 19C and 19D is similar to the control example illustrated in FIGS. 15D and 15E, except that S61 is provided between S21 and S22 of the control example illustrated in FIGS. 15D and 15E and S62 and S63 are provided between S29 and S30 (see portions indicated by dashed lines). Differences from the control example illustrated in FIGS. 15D and 15E will be mainly described.

After S21, the controller 58 clears the determination timer (S61), and the processing transitions to S22. Moreover, after S29, the controller 58 counts up the determination timer (S62), and determines whether or not the count of the determination timer is equal to or less than a predetermined value (e.g., five) (S63). In a case where the count of the determination timer is equal to or less than the predetermined value (S63: Yes), the controller 58 transitions to S30. On the other hand, in a case where the count of the determination timer exceeds the predetermined value (S63: No), the processing transitions to S42 illustrated in FIG.

19D, and the controller 58 takes a retry determination result as NG (S42). The processing returns to the main routine illustrated in FIG. 19A.

The present invention is not limited to the above-described embodiments, and may be embodied in various other forms. These embodiments are therefore to be considered as mere examples in all respects, and shall not be interpreted in a limited manner. The scope of the present invention is indicated by the claims, and shall not be restricted by the foregoing description of the specification. Further, all variations and changes which come within the range of equivalency of the claims are intended to be embraced within the scope of the present invention.

DESCRIPTION OF REFERENCE NUMERALS

1 image forming apparatus
2 image forming apparatus body
20 image former
24 developing device
25 transfer roller
26 photoconductor cleaning device
27 intermediate hopper
28 toner cartridge
58 controller
100A toner cartridge extrusion device
100B toner cartridge extrusion device
101 toner cartridge extrusion device body
110 driver
111 rotary shaft
120 detector
121 light emitter
122 light receiver
130 arm member
131 body portion
132 arm portion.
140A movement member
140B movement member
141 body portion
141*a* support shaft
142 detector target
150 first biasing member
160 cam member
160*a* rotary shaft
161 inclined portion
170 drive transmitter
176 sixth gear (rotary member)
180 second biasing member
200 drive device
B rotation axis direction
C longitudinal direction
D height direction
N longitudinal direction
R detachment direction
S insertion direction
W1 first swing direction
W2 second swing direction
X1 first rotation direction
X2 second rotation direction
Y1 first rotary movement direction
Y2 second rotary movement direction

What is claimed is:

1. A toner cartridge extrusion device that extrudes a toner cartridge with a driving force of a driver, the toner cartridge extrusion device comprising:

an arm member which extrudes the toner cartridge with the driving force of the driver;

a movement member which is moved by the driving force of the driver; and a single detector that performs drive detection to detect drive of the driver and extrusion detection to detect whether or not the toner cartridge has been extruded, wherein the movement member is provided with a detector target which is to be detected by the single detector, the arm member is provided with the movement member, the single detector performs the drive detection based on a movement operation of the movement member while performing the extrusion detection based on an extrusion operation of the arm member, the arm member is movable between an extrusion position at which the arm member extrudes the toner cartridge and a retraction position to which the arm member retracts from the extrusion position, the movement member is movable such that the detector target is displaced between a first detection position at which the single detector detects the detector target and a first non-detection position at which the single detector does not detect the detector target, the driver is a rotary driver which extrudes the toner cartridge with a rotary driving force, the drive detection is rotation detection for the rotary driver, the toner cartridge extrusion device further includes a biasing member which biases the arm member to the retraction position, and a cam member which extrudes, against a biasing force of the biasing member, the arm member to the extrusion position with a rotary driving force of the rotary driver in a second rotation direction opposite to a first rotation direction, and the cam member moves the movement member with a rotary driving force of the rotary driver in the first rotation direction such that the detector target is alternately displaced between the first detection position and the first non-detection position.

2. The toner cartridge extrusion device according to claim 1, wherein the driver is a rotary driver which extrudes the toner cartridge with a rotary driving force, and the drive detection is rotation detection for the rotary driver.

3. The toner cartridge extrusion device according to claim 2, wherein the rotary driver is a toner motor which supplies toner in the toner cartridge to a developing device.

4. The toner cartridge extrusion device according to claim 3, wherein the rotation detection by the single detector is detection of a number of rotations of the toner motor.

5. The toner cartridge extrusion device according to claim 1, wherein the retraction position of the arm member is a second non-detection position at which the single detector does not detect the detector target, and the extrusion position of the arm member is a second detection position at which the single detector detects the detector target.

6. An image forming apparatus comprising:

the toner cartridge extrusion device according to claim 1.

7. A toner cartridge extrusion device that extrudes a toner cartridge with a driving force of a driver, the toner cartridge extrusion device comprising:

an arm member which extrudes the toner cartridge with the driving force of the driver;

a movement member which is moved by the driving force of the driver; and a single detector that performs drive detection to detect drive of the driver and extrusion detection to detect whether or not the toner cartridge has been extruded, wherein the movement member is provided with a detector target which is to be detected by the single detector, the arm member is provided with the single detector, the single detector performs the drive detection based on a movement operation of the movement member while performing the extrusion detection based on an extrusion operation of the arm member, the arm member is movable between an extrusion position at which the arm member extrudes the toner cartridge and a retraction position to which the arm member retracts from the extrusion position, the movement member is movable such that the detector target is displaced between a first detection position at which the single detector detects the detector target and a first non-detection position at which the single detector does not detect the detector target, the retraction position of the arm member is a second detection position at which the single detector detects the detector target, and the extrusion position of the arm member is a second non-detection position at which the single detector does not detect the detector target.

8. A toner cartridge extrusion device that extrudes a toner cartridge with a driving force of a driver, the toner cartridge extrusion device comprising:

an arm member which extrudes the toner cartridge with the driving force of the driver;

a movement member which is moved by the driving force of the driver; and a single detector that performs drive detection to detect drive of the driver and extrusion detection to detect whether or not the toner cartridge has been extruded, wherein the movement member is provided with a detector target which is to be detected by the single detector, the arm member is provided with the single detector, the single detector performs the drive detection based on a movement operation of the movement member while performing the extrusion detection based on an extrusion operation of the arm member, the arm member is movable between an extrusion position at which the arm member extrudes the toner cartridge and a retraction position to which the arm member retracts from the extrusion position, the movement member is movable such that the detector target is displaced between a first detection position at which the single detector detects the detector target and a first non-detection position at which the single detector does not detect the detector target, the driver is a rotary driver which extrudes the toner cartridge with a rotary driving force, the drive detection is rotation detection for the rotary driver, the toner cartridge extrusion device further includes a biasing member which biases the arm member to the retraction position, and a cam member which extrudes, against a biasing force of the biasing member, the arm member to the extrusion position with a rotary driving force of the rotary driver in a second rotation direction opposite to a first rotation direction, and the movement member is a rotary member rotated by a rotary driving force of the rotary driver in the first rotation direction such that the detector target is alternately displaced between the first detection position and the first non-detection position.

* * * * *